United States Patent [19]

Weinerman et al.

[11] Patent Number: 4,838,054

[45] Date of Patent: Jun. 13, 1989

[54] LATCH AND LOCK ASSEMBLIES WITH LIFT AND TURN HANDLES

[75] Inventors: Lee S. Weinerman, Medina; Frank R. Albris, Parma, both of Ohio; Thomas V. McClinden, Oxford; Timothy H. Wentzell, South Windsor, both of Conn.

[73] Assignee: The Eastern Company, Cleveland, Ohio

[21] Appl. No.: 72,175

[22] Filed: Jul. 10, 1987

Related U.S. Application Data

[63] Continuation-in-part of Ser. No. 859,194, Apr. 28, 1986, Pat. No. 4,683,736, which is a continuation-in-part of Ser. No. 601,648, Apr. 18, 1984, abandoned.

[51] Int. Cl.[4] ..... E05B 13/10

[52] U.S. Cl. ..... 70/208; 70/83; 70/209; 70/210; 292/227; 292/DIG. 31

[58] Field of Search ..... 70/81, 83, 84, 208, 70/431, 451, 466, 489, 483–485, 209, 210; 292/164, 198, 210, 224, 227, 228, 240–242, DIG. 63, DIG. 31, 37

[56] References Cited

U.S. PATENT DOCUMENTS

| | | | |
|---|---|---|---|
| D. 196,424 | 10/1963 | Are | D10/8 |
| D. 210,152 | 2/1968 | Pastva | D50/5 |
| D. 210,153 | 2/1968 | Pastva | D50/5 |
| D. 218,672 | 9/1970 | Lauper | D8/109 |
| D. 230,132 | 1/1974 | Pastva | D8/109 |
| D. 265,965 | 8/1982 | Davis et al. | D8/302 |
| D. 270,328 | 8/1983 | Davis et al. | D8/302 |
| D. 271,562 | 11/1983 | Weinerman | D8/338 |
| D. 292,482 | 10/1987 | Weinerman et al. | D8/302 |
| 1,995,106 | 3/1935 | Roedding | 292/227 X |
| 2,266,119 | 12/1941 | Jacobi | 292/227 |
| 2,317,700 | 4/1943 | Thompson | 292/254 |
| 2,387,187 | 10/1945 | Smith | 70/97 |
| 2,594,940 | 4/1952 | Levine | 70/66 |
| 2,637,585 | 5/1953 | Troche et al. | 292/336.3 |
| 2,642,300 | 6/1953 | Pelcin | 292/173 |
| 2,649,322 | 8/1953 | Mack | 292/173 |
| 2,668,076 | 2/1954 | Troche et al | 292/336.3 |
| 2,703,431 | 3/1955 | Tatom | 292/DIG. 31 X |
| 2,721,751 | 10/1955 | Holritz | 292/169 |
| 2,735,706 | 2/1956 | Pelcin | 292/34 |
| 2,746,784 | 3/1956 | Holritz | 292/175 |
| 2,763,503 | 9/1956 | Tasch et al. | 292/173 |
| 2,784,993 | 3/1957 | Collar | 292/223 |
| 2,840,407 | 6/1958 | Sellon, Jr. | 292/169 |
| 2,871,048 | 1/1959 | Balogh | 292/173 |
| 2,900,204 | 8/1959 | Pelcin | 292/173 |
| 2,916,905 | 12/1959 | Podlesak | 70/150 |
| 2,952,150 | 9/1960 | Matzkin et al. | 70/451 |
| 2,962,320 | 11/1960 | Gilbert | 70/451 X |
| 2,987,908 | 6/1961 | Pelcin | 70/146 |

(List continued on next page.)

OTHER PUBLICATIONS

Southco Inc., *Southco Fasteners Handbook 37,* Concordville, Pa. 19331, date unknown.

Eberhard Manufacturing Co., *Handbook of Latches, Locks, Hinges, Handles, and Related Hardware, No. 103,* Cleveland, Ohio 44136, 1985.

Adams Rite Manufacturing Co., *Hardware for Glass Doors that Swing or Slide,* City of Industry, Calif. 91749, Jan. 1988.

*Primary Examiner*—Gary L. Smith
*Assistant Examiner*—Suzanne L. Dino
*Attorney, Agent, or Firm*—David A. Burge

[57] ABSTRACT

Flush mountable latches and locks for industrial cabinets, tool carts, electrical equipment enclosures and the like utilize versatile housings of novel configuration together with pivotally nestable and extensible handles that are movable relative to the housing to effect latching and unlatching movements of a resilient foot that is movable by the handle between clamped and released engagement with a keeper, and that is movable with a latch arm between latched and unlatched positions. The lock-type embodiment has a locking mechanism that is mounted on the housing to selectively permit and prevent unlatching movements of the resilient latch member. The resulting arrangement provides sturdy latch and lock assemblies that employ a small number of relatively movable parts that can be assembled and serviced with ease.

34 Claims, 8 Drawing Sheets

U.S. PATENT DOCUMENTS

| | | | |
|---|---|---|---|
| 3,044,287 | 7/1962 | Pelcin | 70/99 |
| 3,044,814 | 7/1962 | Pelcin | 292/126 |
| 3,055,204 | 9/1962 | Pelcin | 70/153 |
| 3,081,617 | 3/1963 | McKay | 70/153 |
| 3,111,833 | 11/1963 | Dettmer | 70/208 X |
| 3,209,563 | 10/1965 | Pelcin | 70/146 |
| 3,209,564 | 10/1965 | Pelcin | 70/148 |
| 3,338,610 | 8/1967 | Pelcin et al. | 292/126 |
| 3,357,734 | 12/1967 | Pastva, Jr. | 292/165 |
| 3,371,511 | 3/1968 | Atkinson | 70/71 |
| 3,389,932 | 6/1968 | Pastva, Jr. | 292/173 |
| 3,449,005 | 6/1969 | Pastva, Jr. | 292/173 |
| 3,495,862 | 2/1970 | McClintock | 292/173 |
| 3,508,778 | 4/1970 | Legge et al. | 292/DIG. 31 X |
| 3,550,412 | 12/1970 | Pitel et al. | 70/208 X |
| 3,558,167 | 1/1971 | Atkinson | 292/228 |
| 3,576,118 | 4/1971 | Doerrfeld | 70/146 |
| 3,659,445 | 5/1972 | Eads et al. | 70/451 |
| 3,668,907 | 6/1972 | Pastva, Jr. | 70/153 |
| 3,707,862 | 1/1973 | Pastva, Jr. | 70/150 |
| 3,743,336 | 7/1973 | Andrews | 292/173 |
| 3,758,140 | 9/1973 | Prete, Jr. | 292/223 |
| 3,782,141 | 1/1974 | Doerrfeld | 70/146 |
| 3,795,416 | 3/1974 | Hehl et al. | 292/336.3 |
| 3,841,674 | 10/1974 | Bisbing et al. | 292/175 |
| 3,850,464 | 11/1974 | Bisbing et al. | 292/175 |
| 3,857,594 | 12/1974 | Pastva, Jr. | 292/27 |
| 3,871,198 | 3/1975 | Miller | 70/146 |
| 4,021,073 | 5/1977 | Manning | 292/228 X |
| 4,038,718 | 8/1977 | Reilhac et al. | 16/110 |
| 4,116,027 | 9/1978 | Tannery | 70/472 |
| 4,131,002 | 12/1978 | Gianelo | 70/84 |
| 4,132,092 | 1/1979 | Steinbach | 70/208 X |
| 4,134,281 | 1/1979 | Pelcin | 70/208 |
| 4,138,869 | 2/1979 | Pelcin | 70/151 |
| 4,170,119 | 10/1979 | Kalis, Jr. | 70/221 |
| 4,177,656 | 12/1979 | Davis | 70/84 |
| 4,231,597 | 11/1980 | Pelcin | 292/164 |
| 4,309,884 | 1/1982 | Davis | 292/DIG. 31 X |
| 4,312,202 | 1/1982 | Pastva, Jr. et al. | 70/472 |
| 4,312,203 | 1/1982 | Davis | 70/472 |
| 4,312,204 | 1/1982 | Davis | 70/472 |
| 4,312,205 | 1/1982 | Reed et al. | 70/472 |
| 4,320,642 | 3/1982 | Pastva, Jr. | 70/472 |
| 4,321,812 | 3/1982 | Pelcin | 70/472 |
| 4,335,595 | 6/1982 | Swan et al. | 70/149 |
| 4,370,874 | 2/1983 | Munn | 70/204 |
| 4,413,849 | 11/1983 | Davis et al. | 292/229 |
| 4,420,954 | 12/1983 | Hieronymi et al. | 70/150 |
| 4,438,964 | 3/1984 | Peters | 292/216 |
| 4,465,328 | 8/1984 | Tihanyi et al. | 312/215 |
| 4,489,904 | 12/1984 | Soederberg | 292/DIG. 31 X |
| 4,492,394 | 1/1985 | Dignan | 292/64 |
| 4,498,319 | 2/1985 | Balducci et al. | 70/489 X |
| 4,510,779 | 4/1985 | Ahad | 70/208 |
| 4,578,968 | 4/1986 | Messier, Jr. | 70/208 |
| 4,671,547 | 6/1987 | Weinerman et al. | 292/197 |
| 4,676,081 | 6/1987 | Craig | 292/DIG. 31 X |
| 4,679,835 | 7/1987 | Weinerman et al. | 292/197 |
| 4,683,736 | 8/1987 | Weinerman et al. | 70/208 |
| 4,693,503 | 9/1987 | Bisbing | 292/DIG. 31 X |
| 4,706,478 | 11/1987 | Swan et al. | 70/208 |
| 4,707,006 | 11/1987 | Garg et al. | 292/DIG. 31 X |

LATCH AND LOCK ASSEMBLIES WITH LIFT AND TURN HANDLES

The present application is a continuation-in-part of a co-pending application entitled CABINET LOCK WITH RECESSED HANDLE, Ser. No. 859,194 filed Apr. 28, 1986 by Lee S. Weinerman et al as a continuation-in-part of application Ser. No. 601,648 filed Apr. 18, 1984 (now abandoned), which applications are referred to hereinafter as the "Parent Cases," the disclosures of which are incorporated herein by reference. Application Ser. No. 859,194 issued Aug. 4, 1987 as U.S. Pat. No. 4,683,736.

CROSS-REFERENCE TO RELATED APPLICATIONS

Reference is made to the following related, concurrently-filed applications, the disclosures of which are incorporated herein by reference:

LATCH AND LOCK HOUSINGS, HANDLES AND MOUNTING BRACKETS, Ser. No. 072,176, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case I;"

LATCH AND LOCK ASSEMBLIES WITH SPRING-BIASED SLIDE BOLTS, Ser. No. 072,177, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case II;"

LATCH AND LOCK ASSEMBLIES WITH SPRING-BIASED PIVOT BOLTS, Ser. No. 072,174, filed July 10, 1987 by Lee S. Weinerman, Steven A. Mayo, Thomas V. McLinden and Timothy H. Wentzell, hereinafter referred to as the "Utility Case III;"

LATCH AND LOCK ASSEMBLIES WITH EXPANSIBLE LATCH ELEMENTS, Ser. No. 072,250 filed July 10, 1987 by Lee S. Weinerman, Steven A. Mayo, Thomas V. McLinden and Timothy H. Wentzell, hereinafter referred to as the "UTILITY CASE V;"

HOUSINGS FOR LATCHES AND LOCKS, Ser. No. 072,282, filed July 10, 1987 by Richard H. Russell, David W. Kaiser and Richard M. O'Grady, hereinafter referred to as the "Design Case I;"

COMBINED HOUSINGS AND HANDLES FOR LATCHES AND LOCKS, Ser. No. 072,283, filed July 10, 1987 by Richard H. Russell, David W. Kaiser and Richard M. O'Grady, hereinafter referred to as the "Design Case II;"

COMBINED HOUSINGS AND HANDLES FOR LATCHES AND LOCKS, Ser. No. 072,285, filed July 10, 1987 by Richard H. Russell and David W. Kaiser, hereinafter referred to as the "Design Case III;"

COMBINED HOUSINGS AND HANDLES FOR LATCHES AND LOCKS, Ser. No. 072,284, filed July 10, 1987 by Richard H. Russell and David W. Kaiser, hereinafter referred to as the "Design Case IV;"

COMBINED HOUSINGS AND HANDLES FOR LATCHES AND LOCKS, Ser. No. 072,276, filed July 10, 1987 by Richard H. Russell and David W. Kaiser, hereinafter referred to as the "Design Case V;"

COMBINED HOUSINGS AND HANDLES FOR LATCHES AND LOCKS, Ser. No. 072,573, filed July 10, 1987 by Richard H. Russell and David W. Kaiser, hereinafter referred to as the "Design Case VI;"

COMBINED HOUSINGS AND HANDLES FOR LATCHES AND LOCKS, Ser. No. 072,277, filed July 10, 1987 by Richard H. Russell and David W. Kaiser, hereinafter referred to as the "Design Case VII;"

MOUNTING BRACKETS FOR LATCHES AND LOCKS, Ser. No. 072,278, filed July 10, 1987 by Richard H. Russell and Thomas V. McLinden, hereinafter referred to as the "Design Case VIII;"

MOUNTING BRACKETS FOR LATCHES AND LOCKS, Ser. No. 072,280, filed July 10, 1987 by Richard H. Russell and Thomas V. McLinden, hereinafter referred to as the "Design Case IX;"

STRIKERS FOR USE WITH LATCHES AND LOCKS, Ser. No. 072,279, filed July 10, 1987 by Lee S. Weinerman and Steven A. Mayo, hereinafter referred to as the "Design Case X;" and, STRIKERS FOR USE WITH LATCHES AND LOCKS, Ser. No. 072,281, filed July 10, 1987 by Lee S. Weinerman and Steven A. Mayo, hereinafter referred to as the "Design Case XI."

BACKGROUND OF THE INVENTION

1. Field of the Invention

The present invention relates generally to flush mounted latches and locks of the type used with closures for industrial cabinets, tool carts, electrical equipment enclosures and the like. More particularly, the present invention relates to novel and improved latches and locks that utilize a highly versatile housing together with other interactive components of novel form to provide desired types of latching and locking actions.

2. Prior Art

Flush mounted latches and locks including a body, a latch bolt movably carried on the body, and an operating handle that is nested by the body are well known. Normally the handle is in a flush or nested position when the bolt is in a latched position; and unlatching movement of the bolt is effected by moving the handle to an operating position. Latches and locks of this type are well suited for use on industrial cabinets, tool carts, electrical equipment enclosures and the like.

Flush-mounted latches and locks having pan-shaped housings that nest paddle-shaped operating handles, and that have spring-projected slide bolts are disclosed in such U.S. Pat. Nos. as 4,335,595, 4,321,812, 4,320,642, 4,312,205, 4,312,204, 4,312,203, 4,312,202, 4,309,884, 4,231,597, 4,138,869, 3,707,862, 3,668,907, 3,449,005, 3,389,932, 3,357,734, 3,209,564, 3,209,563, 3,055,204, 2,987,908, 2,900,204, and 2,642,300, all of which are assigned to the Eastern Company, a corporation of Connecticut.

Flush mounted latches and locks having latch bolts of other than the spring-projected, slide-mounted type are disclosed in such U.S. Pat. Nos. as 4,413,849, 4,320,642, 4,312,203, 4,134,281, 3,857,594, 3,338,610, 3,044,814, 3,044,287 and 2,735,706, all of which are assigned to the Eastern Company.

A cabinet latch having a housing that is usable with a variety of pivotally mounted latch bolts, and with a variety of latching mechanisms is disclosed in U.S. Pat. No. 4,177,656, assigned to the Eastern Company.

Clamping type cabinet latches that have a capability to clamp shut a cabinet door and/or to compress a cabinet door into firm engagement with a resilient door gasket or other seal structure are known. Among the patents that disclose latches that have clamping capabilities are U.S. Pat. Nos. 4,492,394, 4,413,849 and 4,177,656, assigned to The Eastern Company.

3. The Cross-Referenced Utility and Design Cases

The present invention, and the inventions described in the several referenced Utility and Design Cases, represent the work products of a long term and continuing development program.

The several functional features that form the subjects matter of the referenced Utility Cases, and the several appearance features that form the subjects matter of the referenced Design Cases, were developed by various co-workers, as is reflected in the listing of inventors in these cases. Many of the functional and appearance features that are claimed in separate ones of the referenced Utility and Design Cases were developed substantially concurrently.

If an invention feature that is disclosed in one of the referenced Utility and Design Cases constitutes a species of a development concept that is utilized in another of the these related cases, it will be understood that care has been taken to present a generic claim in the case that describes the earliest development of a species that will support the generic claim. In this manner, a careful effort has been made to establish clear lines of demarcation among the claimed subjects matter of this and the several referenced Utility and Design Cases. No two of these cases include claims of identical scope.

4. The Referenced Parent Cases

The referenced Parent Cases discloses a simple means for retaining a key cylinder assembly in a lock housing. The lock housing has a generally cylindrical opening formed therethrough that extends along an axis for mounting a key cylinder assembly for rotation about the axis. Axially extending grooves are formed in an internal wall that defines the cylindrical opening. One of the grooves (referred to as an "installation groove") extends rearwardly and opens through such rear wall portions of the housing as surround the cylindrical opening. The grooves serve the function of cooperating with key operated tumblers of the key cylinder assembly that project radially from opposed sides of the key cylinder assembly to selectively permit and prevent rotation of the key cylinder assembly relative to the housing. The installation groove serves the function of permitting an offset projection that is carried on the back of the key cylinder assembly to be inserted completely through the cylindrical opening of the housing as the key cylinder assembly is installed in the cylindrical opening. Once the key cylinder assembly is installed, it is rotated to position the offset projection out of alignment with the installation groove so that the offset projection extends in overlying relationship with such rear wall portions of the housing as surround the cylindrical opening in which the key cylinder assembly is installed. By this arrangement, so long as the key cylinder is prevented from rotating relative to the housing to a position where the offset projection aligns with the installation groove, the offset projection serves to retain the key cylinder assembly in place on the housing.

As will be explained in greater detail, the type of housing features that are described above, and that also are disclosed in the referenced Parent Cases, are utilized in the preferred practice of the present invention. For this reason, the present application is being filed as a continuation-in-part case, with the benefits of the filing dates of the referenced Parent Cases being claimed.

SUMMARY OF THE INVENTION

The present invention provides novel and improved flush mountable latches and locks for industrial cabinets, tool carts, electrical equipment enclosures and the like, with the latches and locks utilizing a highly versatile housing together with other interactive components of novel form to provide desired types of latching and locking actions.

A latch or lock embodying the preferred practice of the present invention includes a one-piece housing on which are mounted other interactive components that provide a variety of desired features. As will become apparent from the description that follows, the versatile housing that is used with latches and locks that embody the preferred practice of the present invention provides a rigid, sturdy base structure for securely supporting latch and lock components. Latches and locks that embody the preferred practice of the present invention advantageously employ small numbers of relatively movable parts that can be assembled and serviced with ease.

The versatile housing on which other operating components are mounted preferably is formed form a suitable thermoplastics material such as a glass reinforced polycarbonate based polymer blend, which provides a dimensionally stable, impact resistant structure that is rigid, strong and can be readily machined as may be needed to provide mounting formations for movably mounting operating handles of a wide variety of types. The molded housing defines a pan-shaped structure that has a forwardly facing recess for nesting an operating handle. A pair of threaded mounting studs have enlarged head portions that are embedded in the molded material of the housing so that the threaded studs project rearwardly from a back wall of the housing for receiving mounted posts that are threaded onto the studs for mounting latch and lock operating components, and for establishing connections with a mounting bracket.

A feature of the latch and lock units that embody the preferred practice of the present invention resides in their use of a lift-and-turn handle and shank sub-assembly, with a shank that moves axially to position a latch arm, and that rotates to position a resilient foot between latched and unlatched positions. Axial movement of the shank and the latch arm is effected by pivoting the handle between a normal "nested" position with respect to the housing, and an operating position that is "extended" with respect to the housing.

A further feature of the invention resides in the use of a resilient foot for clampingly engaging a door structure or keeper formation to retain "closed" a closure on which the latch or lock unit is mounted with the resilient foot being adjustably carried on the latch arm, and with the latch arm being adjustably carried on the shank.

While latch and lock structures that embody the preferred practice of the present invention have latch arms that are pivotally mounted and carry resilient feet for clampingly retaining a closure in its closed position, not all of the features of the invention are limited to use with locks and latches that have pivoted latch arms that effect clamping, as will be apparent to those skilled in the art from the description and claims that follow.

BRIEF DESCRIPTION OF THE DRAWINGS

These and other features, and a fuller understanding of the invention may be had by referring to the description and claims that follow, taken in conjunction with the accompanying drawings, wherein:

FIG. 6 is a right side elevational view thereof, with the handle in its normally nested position, with the latch arm pivoted to its latched position, with the resilient foot in its clamped position, and with locking components locked;

DESCRIPTION OF THE PREFERRED EMBODIMENT

Figure 1:
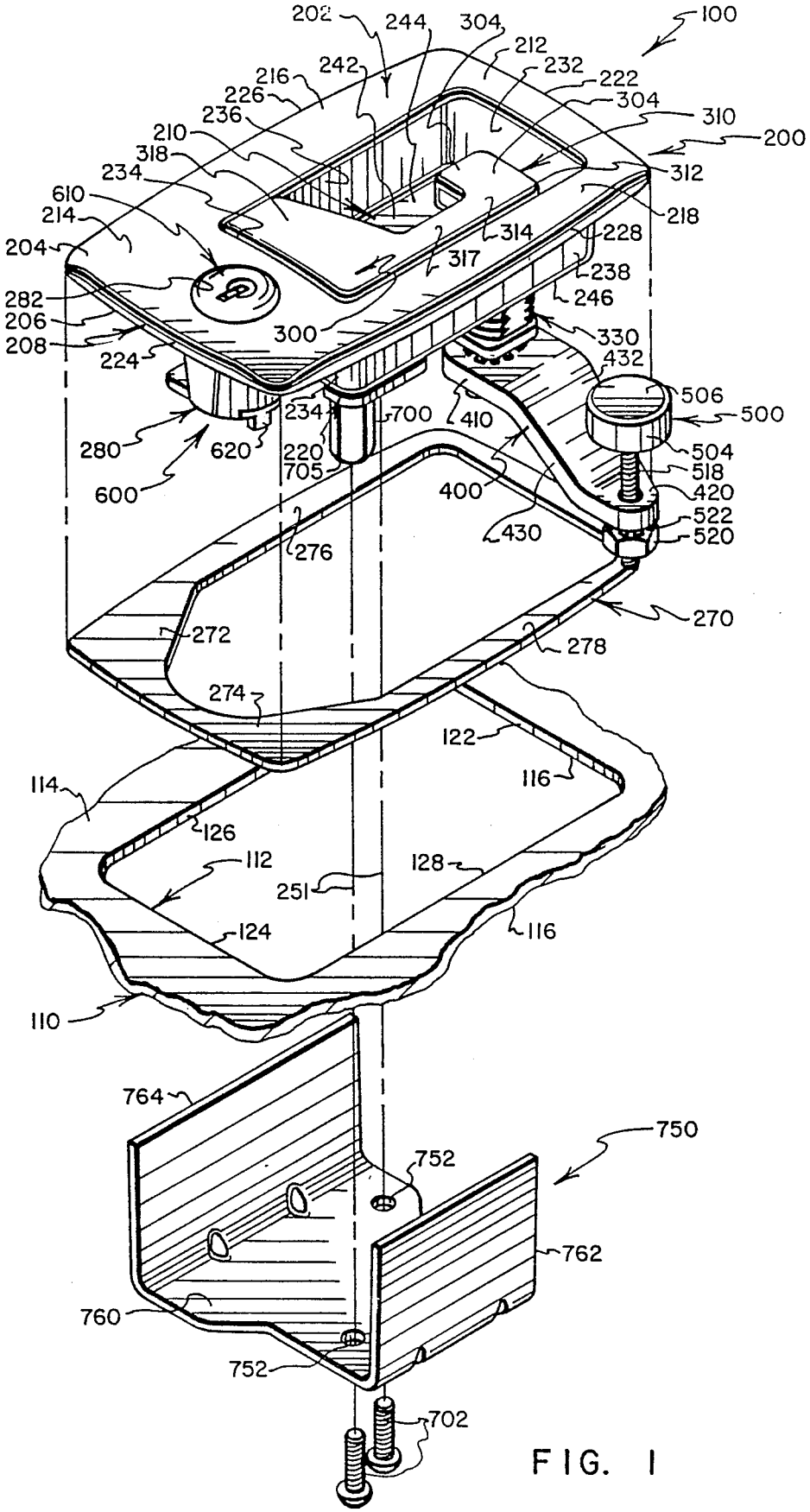
FIG. 1 is an exploded perspective view of one form of lock assembly that embodies features of the preferred practice of the present invention, illustrating how the lock assembly is mounted on a closure.

Referring to FIG. 1, one form of a lock assembly that embodies features of the preferred practice of the present invention is indicated generally by the numeral 100. The lock assembly 100 has a housing 200 that mounts a plurality of interactive components that provide latching and locking functions. In preferred practice, the latch and lock components that are described below are formed either from a durable thermoplastics material that will be described, or from stainless steel, whereby the resulting latch and lock units can be utilized in most normal environments without special concern about deterioration from causes such as corrosion.

In overview, and as will be explained in greater detail, the interactive components that are carried on the housing 200 principally include a handle and shank assembly 300 including a handle 310 that is mounted on an elongate shank 320 that is journaled by a barrel 330, with the barrel 330 being rigidly connected to the housing 200, and with the handle 310 being movable relative to the housing 200 between normal and operating positions; a pivotal latch arm 400 that is mounted on the shank 320 for movement between latched and unlatched positions with the latch arm 400 carrying a resilient foot 500 that is movable between clamped and released positions when the latch arm is in its latched position; and, a locking mechanism 600 for selectively permitting and preventing movement of the latch arm 400 by the handle and shank assembly 300. If the locking mechanism 600 is omitted, the lock assembly 100 is thereby transformed into a latch assembly, i.e., a unit which has a handle 310 that always can be operated to effect latching and unlatching movement of the latch arm 400, and to effect clamping and releasing movements of the resilient foot 500.

Appearance features of the combined housing and handle (i.e., the housing 200 and the handle 310) are shown in greater detail in the referenced Design Case III.

Referring to FIG. 1, it will be seen that the handle 310 and the latch arm 400 are connected to opposite end regions of an elongate shaft-like shank 320, whereby these interconnected elements are pivotal in unison about the axis of the shank 320. The resilient foot 500 projects forwardly from a distal end region of the latch arm 400 for engaging a suitably configured cabinet surface 111 that is located adjacent the lock assembly 100 when a closure 110 (on which the lock assembly 100 is mounted) is "closed." Those skilled in the art will understand that the resilient foot 500 is not limited in use to engaging cabinet structures but rather can be used with a variety of keeper formations, door frames and the like not shown that provide a suitable engagement surface for the resilient foot 500.

Figure 3:
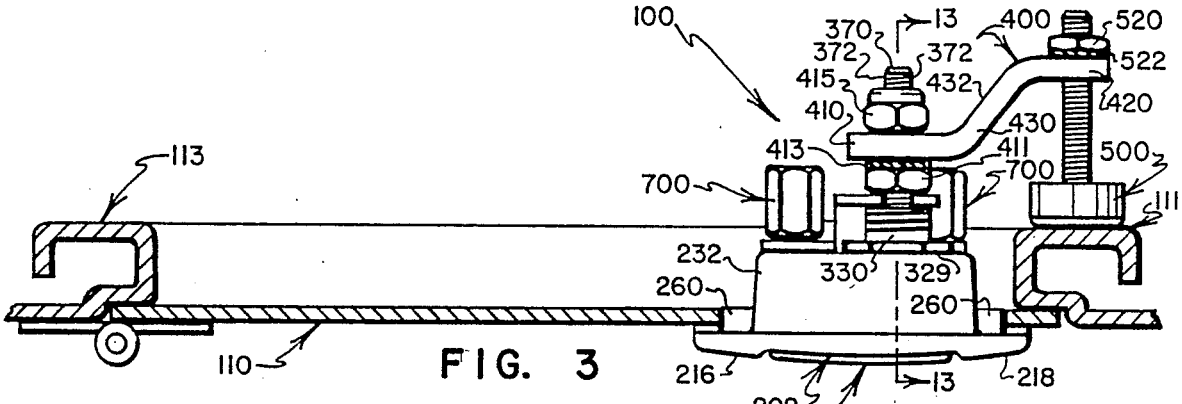
FIG. 3 is a schematic top plan view, on a reduced scale, showing the lock assembly of FIG. 1 installed on a pivotal closure, with cabinet portions shown in cross section, and with the closure shown closed, and with the lock assembly having a resilient foot that clampingly engages portions of the cabinet to clamp the closure closed.

The manner in which the latch arm 400 and the resilient foot 500 cooperate with the cabinet formation 111 in latching and unlatching the closure 110 is depicted in the schematic top views of FIGS. 3-6. Referring to FIG. 3, when the closure 110 is closed with respect to a cabinet structure 113 on which the closure 110 is pivotally mounted, the latch arm 400 of the lock assembly 100 is pivoted to a latched position, i.e., to a position wherein the foot 500 is positioned behind the cabinet portion 111, and the foot 500 is clamped into engagement with the cabinet portion 111 to clamp the closure 110 closed, or into clamping engagement with a door gasket (not shown) that is interposed between the closure 110 and the cabinet 113.

The manner in which the handle 310 is prevented from rotating and axially moving the shank 320 involves novel interaction between the shank 320, a barrel 330 that is rigidly secured to the housing for movably mounting the shank 320 on the housing 200, and the manner in which a locking member 550 that is slidably carried on the housing 200 is moved selectively into and out of engagement with the shank 320. As will be explained in greater detail, a single, simple form of interactive engagement between the locking member 550 and the shank 320 is utilized to provide all essential features of the needed locking action. A simple sliding movement of the locking member 550 out of retaining engagement with the shank 320 releases the handle 310, the latch arm 400 and the resilient foot 500 to execute both clamping/releasing and unlatching/latching movements.

Figure 4:
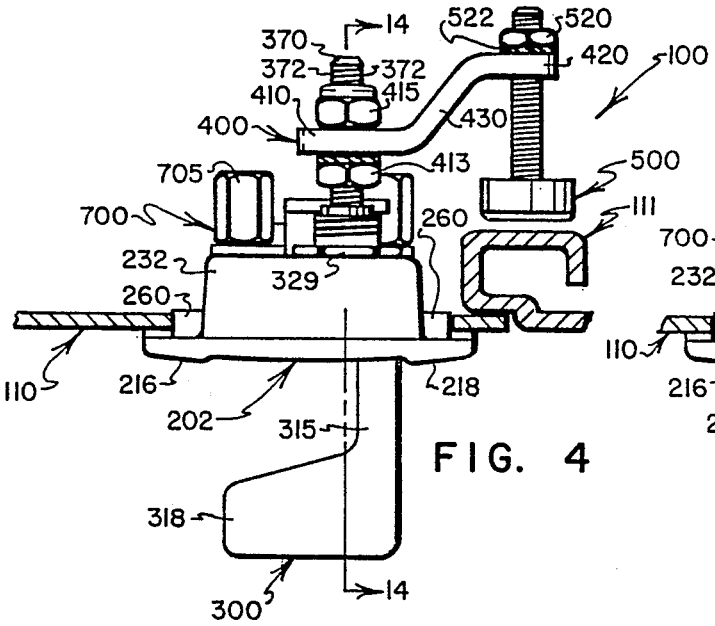
FIG. 4 is a schematic top plan view similar to FIG. 3, but with the handle of the lock assembly pivoted to an operating position to release clamping engagement of the resilient foot with the cabinet.
Figure 5:
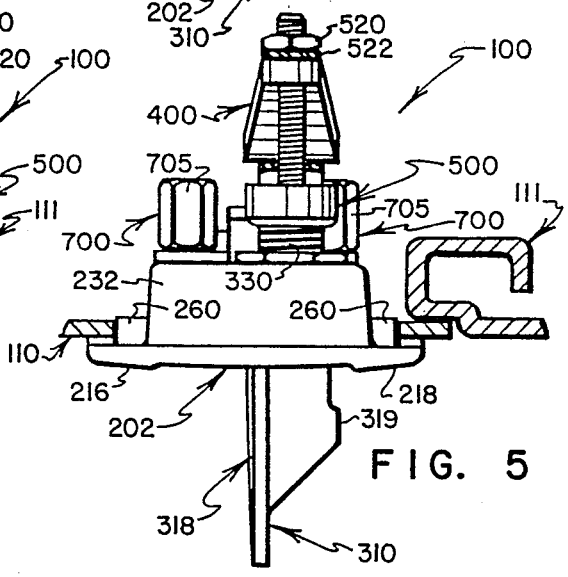
FIG. 5 is a schematic top plan view similar to FIG. 4, but with the handle pivoted to pivot the latch arm and the resilient foot in unlatched positions to enable the closure to open.
Figure 6:
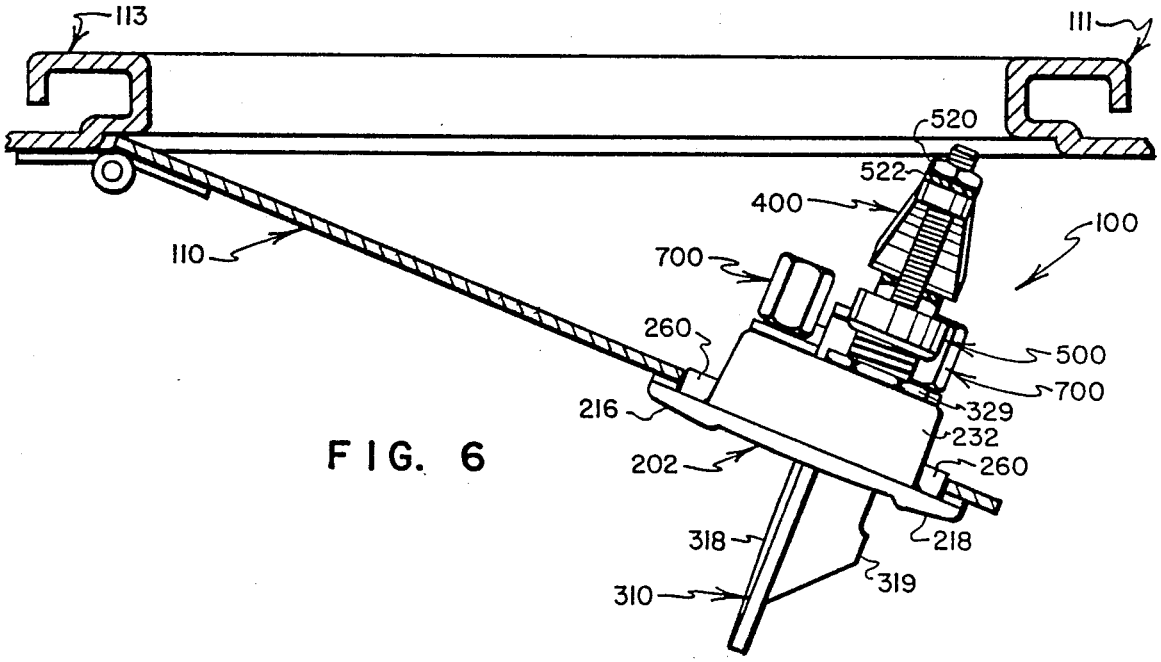
FIG. 6 is a schematic top plan view similar to FIG. 5, but with the closure in an open position.
Figure 7:
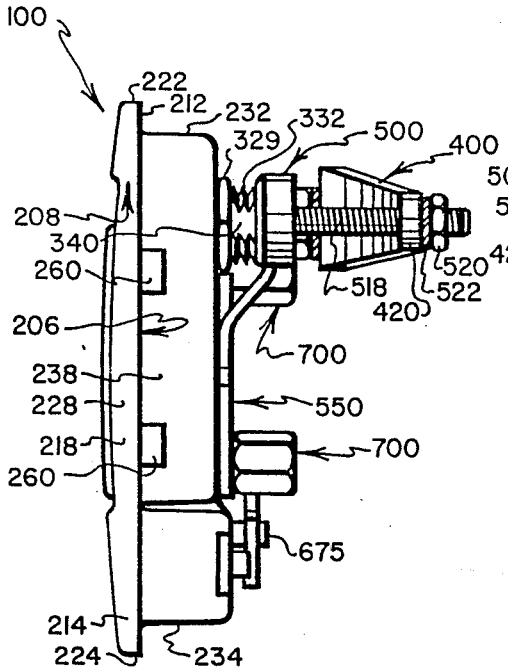

To open the closure 110, the handle 310 is moved to an operating position that is shown in FIG. 4, which action releases the clamping engagement of the foot 500 with the cabinet portion 111. The handle 310 then is rotated to pivot the latch arm 400 to the unlatched position shown in FIG. 5, whereupon the closure 110 can be opened, as is shown in FIG. 6.

Before turning to a more detailed description of the components of the lock assembly 100, the preferred manner in which the lock assembly 100 can be mounted on a closure 110 will be described. The portion of the closure 110 that is shown in FIG. 1 is a plate-like structure that has a mounting opening 112 formed therethrough. The closure portion 110 has a front surface 114 and a rear surface 116 that extend about the perimeter of the opening 112. The opening 112 has top and bottom boundaries 122, 124, and left and right side boundaries 126, 128.

In order to mount the lock assembly 100 on the closure 110, the lock assembly 100 has a pair of mounting posts 700 that project rearwardly for connection to a mounting bracket 750. The mounting bracket 750 is of generally U-shaped configuration, having a back wall 760 that connects at opposite ends with legs 762, 764. The legs 762, 764 extend forwardly from the plane of the back wall 760 toward the mounting flange 202, and cooperate with the housing 200 for clampingly mounting the lock assembly 100 on the closure 110. Appearance features of the mounting bracket 750 are disclosed in greater detail in the referenced Design Case IX.

When the lock assembly 100 is to be installed on the closure 110, a gasket 270 is positioned to engage the mounting flange 202, and portions of the lock assembly 100 are installed through the closure opening 112 to position the gasket 270 adjacent the opening 112 in clamped engagement between the rear face 206 of the mounting flange 202 and the front surface 114 of the closure 110. The mounting bracket 750 is positioned to overlie the lock assembly 100, with the legs 762, 764 of the mounting bracket 750 extending into engagement with the rear surface 116 of the closure 110. Threaded fasteners 702 are installed to extend through holes 752 that are formed through the back wall 760 of the bracket 750. The fasteners 702 are threaded into the mounting posts 700 of the lock assembly 100 to clamp the mounting flange 202 into engagement with the gasket 270, to clamp the gasket 720 into engagement with the front surface 114, and to clamp the legs 762, 764 into engagement with the rear surface 116.

Figure 2:
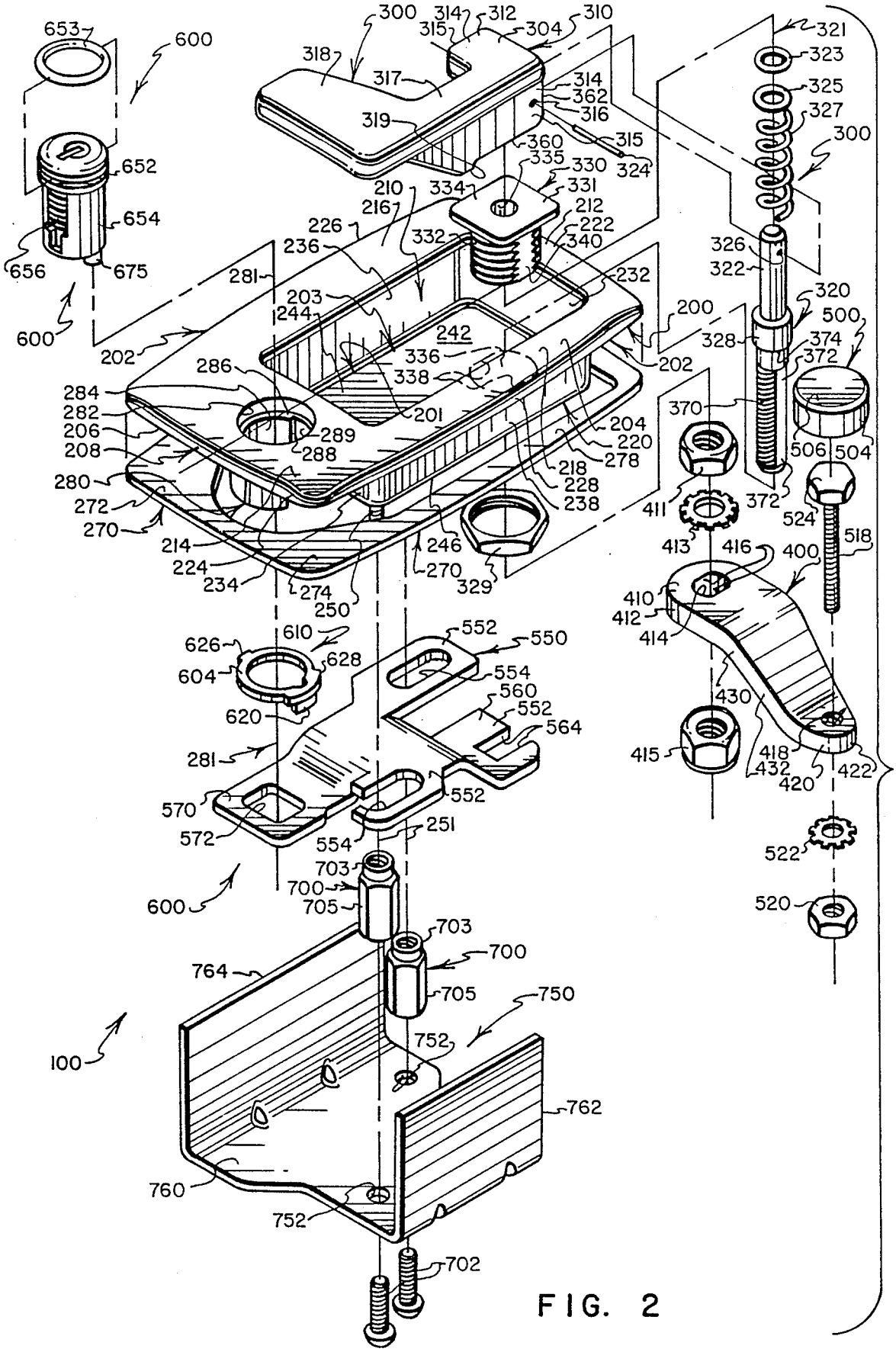
FIG. 2 is an exploded perspective view of components of the lock assembly of FIG. 1.
Figure 10:
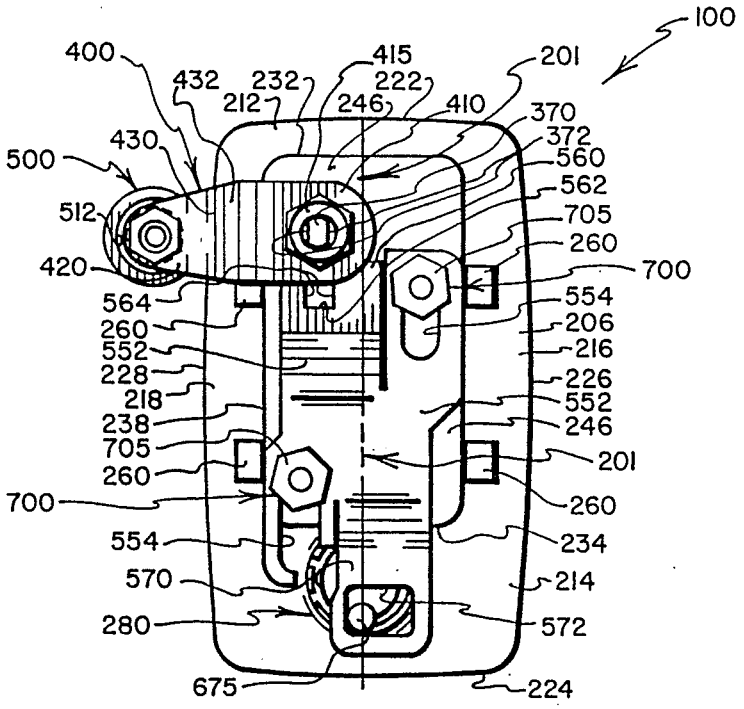
FIG. 10 is a rear elevational view similar to FIG. 8, but with locking components unlocked.
Figure 13:
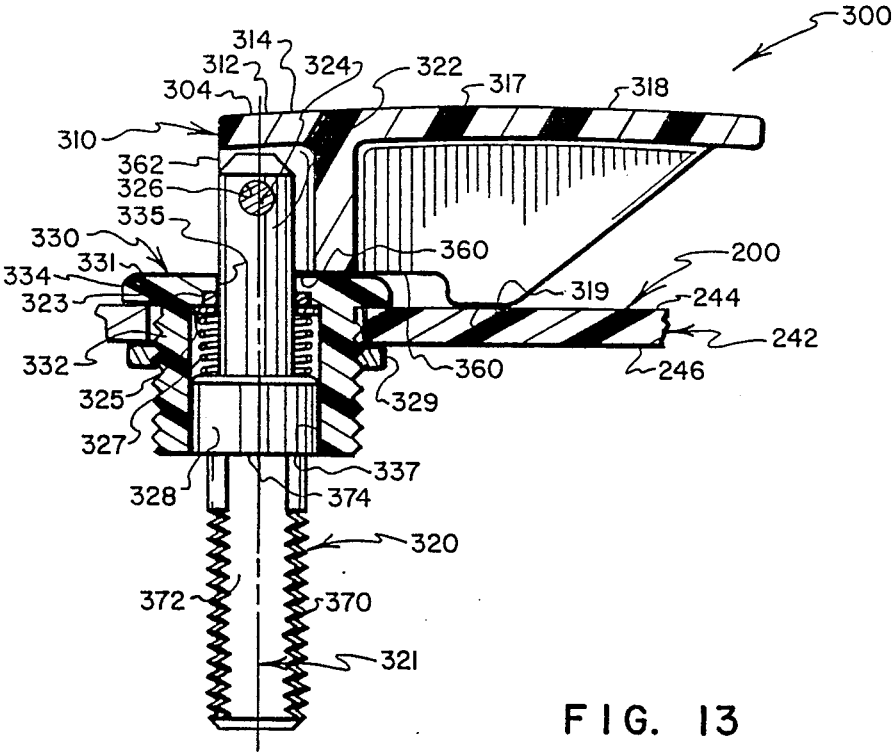
FIG. 13 is a sectional view, on an enlarged scale, of a portion of the lock housing, as seen form a plane indicated by a line 13—13 in FIG. 3.

To facilitate an understanding of the various relative positions of the principal relatively movable components of the lock assembly 100, reference is made to FIGS. 1 and 2 wherein the handle 310 is in its "normal" or "nested" position; the latch arm 400 is in its "latched" position; the resilient foot 500 is in its "clamped" position; and the locking mechanism 600 is "locked" so as to prevent releasing movement of the resilient foot 500 and unlatching movement of the latch arm 400 in response to attempted operation of the handle 310. In FIG. 13, features of the handle and shank assembly as relates to the nested position of the handle 310 are shown. In FIGS. 4 and 10, the locking mechanism 600 of the lock 100 is shown "unlocked" so as to permit releasing and clamping movements of the resilient foot 500, as well as unlatching and latching movements of the latch arm 400 by operation of the handle 310.

Figure 11:
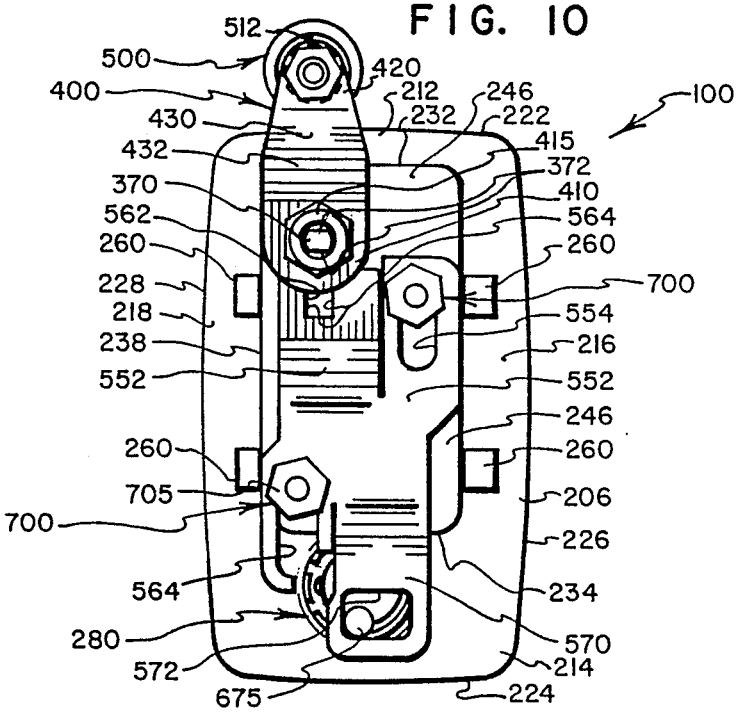
FIG. 11 is a rear elevational view similar to FIG. 10, but with the resilient foot moved from its clamped position to its released position, and with the latch bolt moved to its unlatched position.
Figure 14:
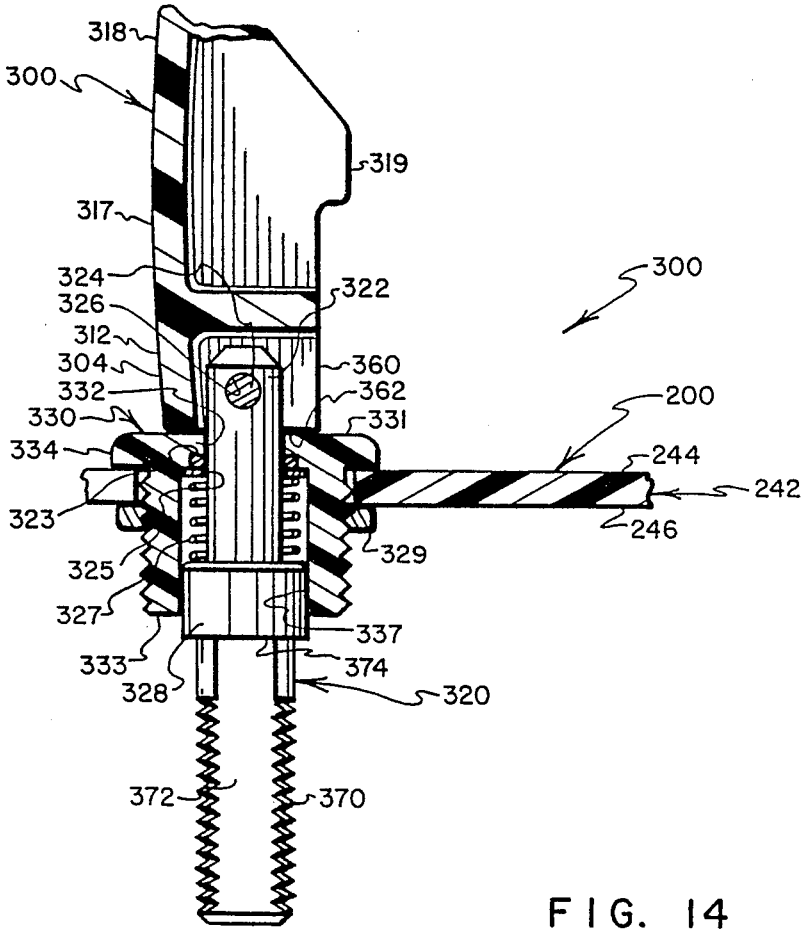
FIG. 14 is a sectional view as seen from a plane indicated by a line 14—14 in FIG. 4.

In FIG. 4, the handle 310 is shown in one of its "operating" positions wherein the handle 310 functions (in conjunction with the operation of other components, as will be described) to move the latch arm 400 rearwardly to release the resilient foot 500 from its clamping engagement with a door frame portion. In FIGS. 5, 6 and 11, the mechanism of the lock 100 is oriented such that the handle 310, the latch arm 400 and the resilient foot 500 are positioned to permit the closure 110 to be opened (see FIGS. 5 and 6), which is to say that the handle 310 has served to rotate the latch arm 400 to its unlatched position. Features of the handle and shank assembly 300 that are applicable to all of the operating positions of the handle 310 are depicted in FIG. 14.

Turning now to a more detailed description of features of the components of the lock assembly 100, the housing 200 is preferably formed as a molded, one piece structure; thus it will be understood that the mounting flange 202 together with walls that form an essentially pan-shaped housing portion 220 (i.e., the walls that define the width, length and depth of the recess 210) are integrally-formed parts of the same one-piece structure. The fabrication of the housing as a one-piece member molded from thermoplastic, material such as a glass reinforced polycarbonate based polymer blend helps to provide a strong, rigid, impact resistant structure, whereby the housing 200 is capable of providing a versatile mounting platform for supporting the various relatively movable components of the lock assembly 100.

A preferred material from which the housing 200 is formed is a thermoplastic that is a glass reinforced polycarbonate based polymer blend, typically of the type sold by General Electric Company, Pittsfield, MA 01201 under the registered trademark XENOY. The most preferred resin blend is about 10 percent glass reinforced, and is selected from the "6000 Series" of the XENOY products sold by General Electric, with XENOY 6240 being preferred. While many other commercially available moldable plastics materials can be used to form the housing 200, as will be apparent to those skilled in the art, the preferred material helps to provide a high strength housing that is light in weight, resists crazing and hardening, is heat and chemical resistant, is resistant to impact, and can be machined as needed to provide suitable mounting holes and the like for movably mounting a wide variety of handles within the confines of the recess 210, as will be explained.

The mounting flange 202 has a front face 204 that defines the front of the housing 200. The mounting flange 202 has a rear face 206 that is substantially flat, i.e., all portions of the rear face 206 extend substantially in a single plane. The mounting flange 202 is bordered by a perimetrically extending edge surface 208 that joins the front and rear surfaces 204, 206 at their peripheries. While all portions of the mounting flange 202 are formed integrally and therefore serve to define elements of a one-piece structure, for purposes of reference, the mounting flange 202 can be thought of as having a top portion 212 that extends across the top of the recess 210, a bottom portion 214 that extends across the bottom of the recess 210, and opposed side portions 216, 218 that extend along left and right sides of the recess 210. Likewise, the edge surface 208 can be thought of as having a top portion 222, a bottom portion 224, and opposed side portions 226, 228. The flange portions 212, 214, 216, 218 and their associated edge portions 222, 224, 226, 228 cooperate to define a mounting flange 202 that has a generally rectangular configuration, with corner regions where adjacent ones of the edge portions 222, 224, 226, 228 join preferably being gently rounded to give an enhanced appearance.

The pan-shaped portion 220 of the housing 200 (i.e., the portion of the housing 200 that defines the forwardly facing recess 210) includes a top wall 232, a bottom wall 234, a pair of opposed side walls 236, 238, and a back wall 242. The back wall 242 is arranged so that it extends substantially parallel to the rear face 206 of the mounting flange 202. Stated in another way, the back wall 242 has a front face 244 and a rear face 246 that extend in planes that substantially parallel the plane of the rear face 206. Particular attention is paid to the molding of the rear face 246 of the back wall 242 so that the rear face 246 provides a smooth, planar back wall surface that can be utilized for the important functions of mounting and guiding the movement of other components of the lock assembly 100, as will be explained.

For the purpose of providing an enhanced appearance, it is preferred that front face 204 of the housing 200 be of curved, slightly convex configuration. Stated in another way, the front face 204 is convexly curved such that the thicknesses of the mounting flange portions 212, 214, 216, 218 increase progressively the closer these formations extend toward an imaginary center point of the front face 204. Likewise, the thicknesses of the mounting flange portions 212, 214, 216, 218 decrease progressively as these formations extend toward the edge surface portions 222, 224, 226, 228. Preferably, the thicknesses of the mounting flange portions 212, 214, 216, 218 as measured at locations that are adjacent to the edge portions 222, 224, 226, 228, are substantially uniform all along the edge surface 208—which is to say that the edge surface 208 has a width that is substantially constant as the edge surface 208 extends about the housing 200. Appearance features of the front face 204 of the housing 200 are within the purview of the referenced Design Case I.

For the purpose of providing an enhanced appearance, the positioning of the top and bottom walls 232, 234 of the pan-shaped housing portion 220 that defines the recess 210 preferably is asymmetrical relative to top and bottom edges 222, 224 of the mounting flange 202. Likewise, for purposes of enhanced appearance, the positioning of the left and right side walls 236, 238 of the pan-shaped housing portion 220 preferably is assymmetrical relative to the left and right opposed side edges 226, 228 of the mounting flange 202. This absence of symmetry in locating the recess 210 relative to opposed top and side edge portions 222, 224 and 226, 228 of the mounting flange 202 results in the top wall portion 212 being relatively short in height in comparison with the relatively tall height of the bottom wall portion 214 that depends beneath the recess 210, and results in the left sidewall portion 216 being relatively wide, while the right side wall portion 218 is relatively narrow.

Several functional features of the housing 200 are arranged substantially symmetrically about the center plane 201, including the side walls 236, 238 of the housing portion 220, and a sleeve-like housing formation 280, which will be described. With respect to the side-to-side positioning of the recess 210 relative to features of the mounting flange 202, however, it will be understood that this is a feature dictated solely by appearance considerations, and not by functional considerations. Indeed, functional features of the lock assembly 100 would not be affected if the narrow flange portions 212, 218 were enlarged to give the flange portions 212, 218 widths that are equivalent to the relatively wider flange portions 214, 216, respectively. Likewise the styling of the front face 204 of the mounting flange 202 is dictated entirely by appearance considerations.

Figure 15:
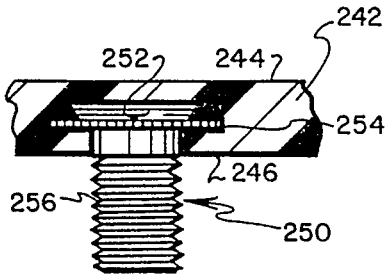
FIG. 15 is a sectional view as seen from a plane indicated by a line 15—15 in FIG. 12.

Threaded studs 250 project rearwardly from the rear face 246 of the back wall 242 for mounting various latch and lock components, as will be explained. Referring to FIG. 15, the threaded studs 250 have enlarged head portions 252 with radially outwardly extending projections 254 that have somewhat of a toothed washer appearance and that are located adjacent the head portions 252. The head portions 252 and the projections 254 are embedded within the molded material of the back wall 242 of the housing 200 to provide structures that are anchored securely to the plastic material of the plastic and will not rotate with request thereto. The studs 250 have elongate threaded shank portions 256 that project rearwardly from the head portions 252. The threaded shank portions 256 extend along spaced imaginary axes 251 that intersect the plane of the back wall 242 at right angles thereto. The axes 251 extend coaxially through the holes 752 that are formed in the back wall 760 of the mounting bracket 750. The axes 251 of the studs 250 are located equidistantly from the center plane 201, and are positioned on opposite sides of the center plane 201.

In preferred practice, the threaded studs 250 are commercially available fasteners that are sold by Penn Engineering and Mfg. Corp. of Danboro, PA, under the trademark PEM. The preferred part is model number CHN-832-4, which is formed from stainless steel, has a tapered head 252 with a maximum diameter of about 0.289 inch, has radially extending projecting portions 254 that have a maximum outer diameter of about 0.328 inch, and has a shank length of about 0.250 inch that is threaded with a standard thread such as 8-32 NC. While these commercially available fasteners are intended for use with sheet metal, not plastic, they have been found to be quite suitable for use in the application described here.

Figure 8:
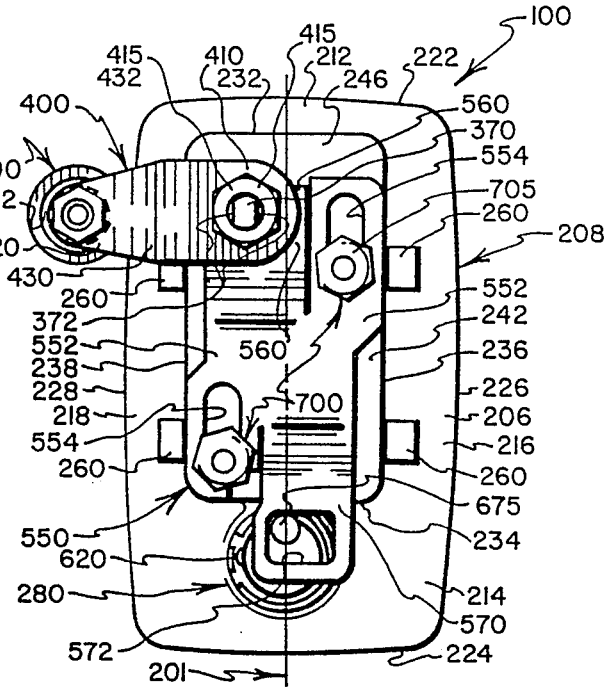
FIG. 8 is a rear elevational view thereof.
Figure 9:
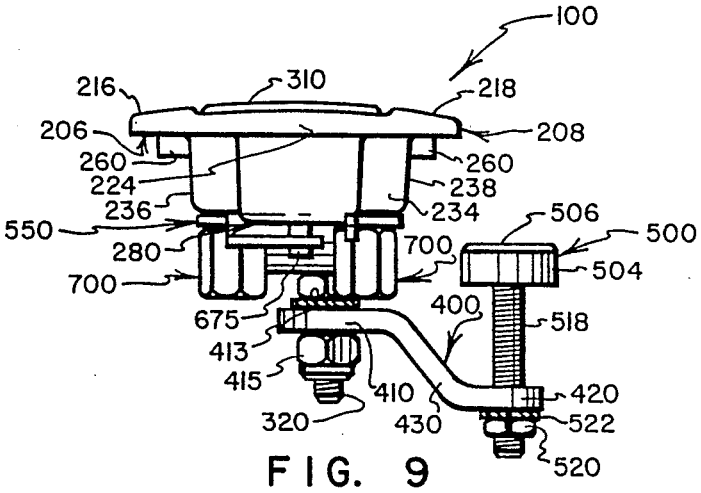
FIG. 9 is a bottom plan view thereof.

Locator projections 260 are provided at spaced locations along the side walls 236, 238 at junctures of the side walls 236, 238 with the rear face 206 of the mounting flange 202. As will be seen in FIG. 8, the locator projections 260 are arranged symmetrically in pairs on opposite sides of the center plane 201. The locator projections 260 are intended to directly engage opposite sides 126, 128 of the opening 112 to orient the lock assembly 100 properly on the closure 110; however, if the opening 112 has been formed so as to be slightly "oversized," the locator projections 260 may be utilized during installation of the lock assembly on the closure 110 as "guides" to visually aid in properly positioning the housing 200 with respect to the closure opening 112, preferably with the locator projections 260 being arranged to be spaced substantially equidistantly from opposite side portions 126, 128 of the opening 112.

While the gasket 270 is not essential in many applications where the lock assembly 100 can be used, the gasket 270 preferably is used in applications that present a possibility that moisture may penetrate the opening 112 as by passing between the back face 206 of the mounting flange 202 and the front face 114 of the closure 110. To aid in properly positioning the gasket 270 about the lock assembly 100, the gasket 270 has an asymmetrical configuration that causes the gasket 270 to extend in an obviously skew, out-of-alignment relationship with respect to the edge portions 226, 228 of the mounting flange 202 if the gasket 270 is installed incorrectly, e.g., in an "inside-out" manner. Specifically, referring to FIGS. 1 and 2 the gasket 270 has a relatively wide left side portion 276 that underlies the relatively wide left side wall 236; similarly, the gasket 270 has a relatively narrow right side portion 278 that underlies the relatively narrow right side wall 238. Further, the gasket 270 has a relatively large, generally triangular-shaped corner region 272 that is configured to underlie a correspondingly large corner portion of the bottom wall 214 of the mounting flange 202, and a relatively smaller, generally triangular shaped corner region 274 that is configured to underlie a correspondingly smaller corner portion of the bottom wall 214 of the mounting flange.

The sleeve-like formation 280 of the housing 200 is located below the recess 210 and extends rearwardly from the rear face 206 of the mounting flange 202 along the bottom wall 234 of the housing portion 220. In preferred practice, the sleeve formation 280 is provided on the housing 200 regardless of whether the sleeve formation 280 is to be utilized to house operating components of a latch or lock.

If the sleeve formation 280 is to be utilized to house latch or lock components, an opening 282 is formed through the front wall 204 to communicate with a passage 284 that extends through the sleeve formation 280. The opening 282 and the passage 284 extend coaxially along an imaginary axis 281 (see FIG. 2) that lies within the imaginary center plane 201 and that extends substantially perpendicular to the planes of the rear face 206 and the back wall 246. If the sleeve formation 280 is not to be utilized to house latch or lock components, either no opening 282 is formed through the front wall 204, or a suitably configured plug (not shown) is installed in the opening 282 to close the opening 282.

Figure 16:
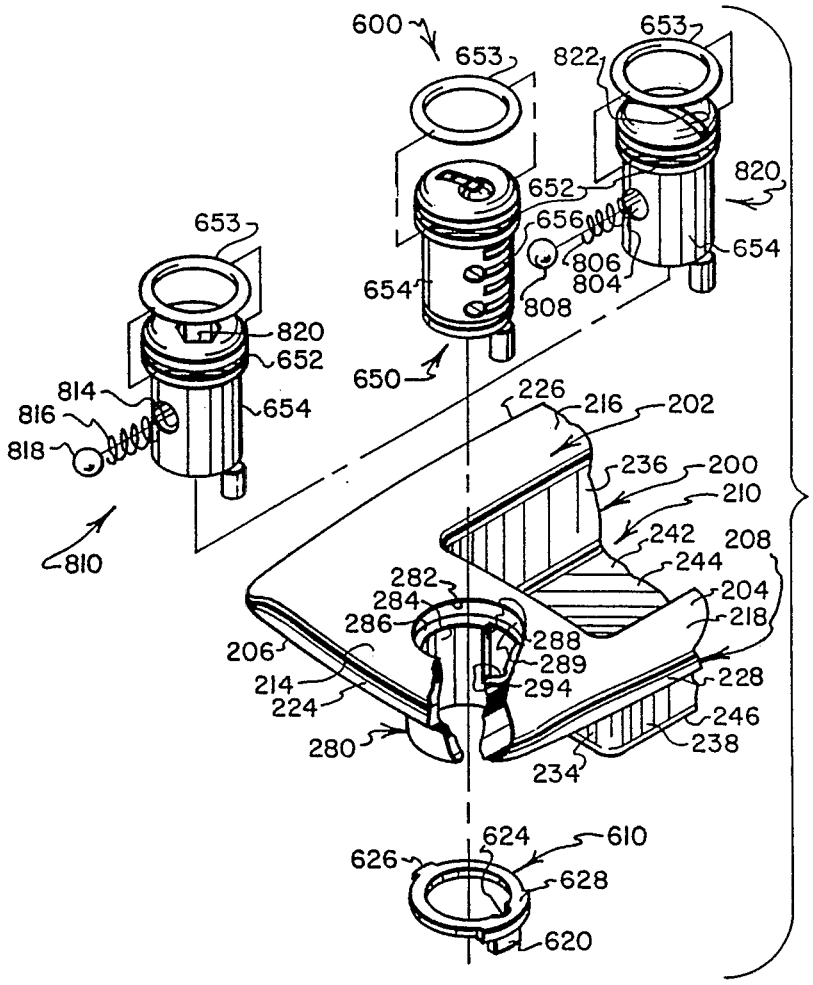
FIG. 16 is an exploded perspective view showing selected components of the lock assembly together with alternate components that can be used; and, FIG. 17 is a perspective view, on an enlarged scale, of rear portions of a housing that is used with the latches and locks of the present invention.
Figure 17:
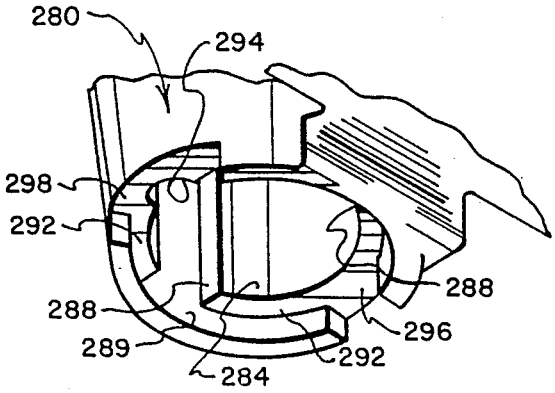

Referring to FIGS. 16 and 17 features of the sleeve formation 280 are shown. The sleeve 280 has a shoulder 286 that extends substantially radially with respect to the axis 281 to form a transition between the relatively large diameter of the opening 282 and the relatively smaller diameter of the passage 284. Axially extending top and bottom grooves 288 are formed in opposed upper and lower portions of the passage 284. The grooves 288 extend axially rearwardly from the shoulder 286 and have bottom walls 289 that are curved and represent continuations of a cylindrical surface 290 of enlarged diameter that is formed in the rearward end region of the sleeve 280. Referring to FIG. 17, a radially extending shoulder 292 forms a transition between the passage diameter that is designated by the numeral 284, and the enlarged diameter end region 290. A rounded installation groove 294 of shallower depth than the grooves 288 is formed in a side of the passage portion 284. The rounded installation groove 294 extends from the shoulder 286 to the shoulder 292.

Referring to FIG. 17, two opposed portions 296, 298 of the shoulder 292 extend radially outwardly and interrupt opposed side portions of the sleeve formation 280 to provide radially extending, rearwardly opening notches that are designated by the numerals 296, 298.

In preferred practice, the housing 200 is formed without any openings, holes, slots or the like extending through the walls that define the recess 210, i.e., the top, bottom, and side walls 232, 234, 236, 238, and the back wall 242 are smooth and have no openings formed therethrough. By this arrangement, a wide variety of types of handles as well as latch and lock components of various forms may be utilized with the housing, as is illustrated and described in the referenced Utility and Design cases. Depending on the type of handle that is to be used with the housing 200, and on the type of latch or lock operating mechanism that is to be mounted on the housing 200, one or more suitable passages through the housing 200 are machined in the form of openings, holes, slots and the like which formed as by drilling, milling or other conventional machining techniques.

For purposes of mounting the handle and shank assembly 300 on the housing, a single hole 336 is formed through the back wall 242 of the housing 200, with opposite sides of the hole 336 having flat surface formations 338 thereon for mating with similarly configured flat surface portions formed on a threaded exterior surface of the barrel 330 to prevent rotation of the barrel 330 relative to the housing 200, as will be explained.

The handle 310 is formed from molded plastics material, preferably of the same thermoplastics material from which the housing 200 is formed. The handle 310 has a front surface 304 that is of complexly curved, generally convex shape, and is configured to extend in a flush, substantially contiguous manner to smoothly continue the curvature of the complexly curved, convex front surface 204 of the mounting flange 202 when the handle 310 is in its normal or nested position. The handle 310 is mounted on the housing 200 for movement between a normally nested position that is, shown in FIGS. 1, 3, 7–10, and 13 operating positions that are depicted in FIGS. 4–6, 11 and 14.

The handle 310 has an end region 312 that defines a mounting formation 314 that is pivotally connected to the elongate shank 320 by a roll pin 324. The roll pin 324 extends through aligned holes 316 that are formed through spaced side parts 315 of the mounting formation 314, and through a hole 326 that is formed in a front end region 322 of the elongate shank 320. The mounting formation 314 receives the front end region 322 of the shank 320 between its side parts 315. The holes 316 that are formed in the spaced side parts 315 of the mounting portion 314 receive opposed end regions of the roll pin 324 in a press fit. The shank hole 326 receives the pin 324 in a slip fit, whereby the pin 324 (and the handle 310 to which the pin 324 is rigidly connected) are free to pivot relative to the shank 320.

Figure 12:
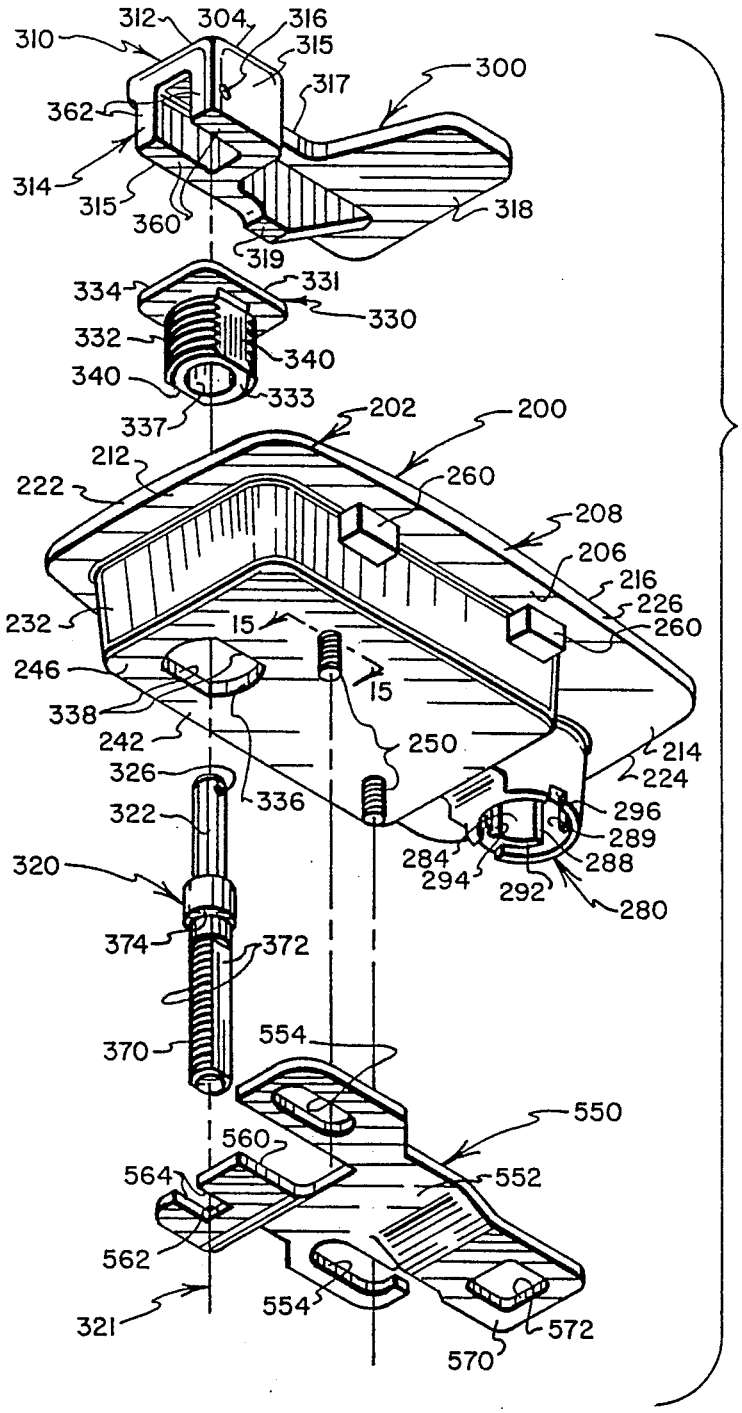
FIG. 12 is an exploded perspective view showing selected portions of the lock assembly with the view showing principally rear features thereof.

The handle 310 has a front surface 304 that is complexly curved to conform to the complexly curved configuration of the front face 204 of the housing 200. The front surface 304 overlies the front end region 322 of the shank 320 and extends away from the shank 320 to provide an L-shaped handle portion that includes a narrow connections leg 317 that connects with a relatively wider leg 318 that can be engaged and grasped by an operator to move the handle 310 between its nested and operating positions. A stop formation 319 is formed on the connecting leg 317 for engaging the housing back wall 242 when the handle 310 is nested, as is best seen in FIGS. 12 and 13.

Referring to FIGS. 2 and 12–14, the barrel 330 has a threaded body 332 with an enlarged, generally rectangular head 334 formed at its front end. A front surface 331 is provided on the head 339. An end surface 333 is provided on the threaded body 332. Flat surfaces 340 are provided on opposite sides of the threaded body 332. The hole 336 that is formed through the back wall 242 of the housing 200 is sized and configured to closely receive the threaded body 332 of the barrel 330, with the opposed flat surfaces 340 that are provided on the barrel 330 extending closely alongside the flat surface formations 338 of the housing hole 336.

Referring FIGS. 13 and 14, a relatively small diameter hole 335 is formed through the head 331. A relatively large diameter hole 337 is formed through the body 332.

The barrel 330 houses and O-ring seal 323, a washer 325, and a compression coil spring 327 that acts on the washer 325 and on an enlarged diameter portion 328 of the shank 320. The spring 327 biases the shank 320 rearwardly with respect to the housing 200 toward the position depicted in FIG. 14. A stainless steel nut 329 is threaded onto the barrel 330 to hold the barrel 330 in place on the back wall 242.

Referring to FIGS. 12–14, the mounting portion 314 of the handle 310 defines stop surfaces 360, 362 that extend at right angles for engaging the front of the barrel 330 when the handle 310 is in its nested and operating positions, respectively. The stop surface 360 is formed on the upper end region of the mounting formation 314 of the handle 310 for engaging the front 331 of barrel 330 when the handle 310 is in its nested position, as is shown in FIG. 13. The stop surface 362 is formed on an adjacent edge of the mounting formation 314 and serves to engage the front 331 of the barrel 330 when the handle 310 is in its operating position, as is shown in FIG. 14.

Referring to FIGS. 2 and 12–14, the threaded portion 370 of the shank 330 extends rearwardly from the central, relatively large diameter portion 328 and has opposed flats 372 formed on opposite sides thereof. When the handle 300 is nested, a central portion 374 of the shank 320 is housed within the confines of the barrel 330 with a shoulder 374 at the rear end of the central portion 328 extending flush with the barrel end 336. A locking member 550 has a notch 552 that can be slided into locking engagement with flats 372 to prevent rotation, of the handle 300; and with the locking member portion 552 closely underlying the central portion 328 of the shank 320, the central portion 328 of the shank 320 is prevented from moving rearwardly out of the barrel 330 (i.e., rearwardly beyond the barrel end surface 331) whereby the locking member 550 prevents rearward movement of the shank 320.

The relative arrangement of the locking member 550 and the shank 320 is depicted most clearly in FIG. 12. The locking member 550 has a central portion 552 that carries mounting slots 554, and has rearwardly offset portions 560, 570 on opposite end regions thereof. The offset portion 560 carries a notch 552 that has opposed side walls 564 that are engageable in a slip fit with opposed flats that are formed on the shank 320, to thereby prevent rotary movement of the shank 320 and the handle 310. Moreover, the offset portion 560 defines a forwardly facing surface 566 that is engageable with a shoulder that is formed on the shank 320 to prevent rearward axial movement of the shank 320 (and hence unlatching movement of resilient latching member 400).

The slots 554 receive the threaded studs 250; additionally the mounting posts 700 have reduced diameter end regions 703 that extend into the slots 554. By this arrangement, the locking member 550 is mounted for linear sliding engagement along the housing back wall 242.

The offset portion 570 has a rectangular opening 572 that engages an offset projection 675 that is carried on the lock cylinder 650 so as to move the locking member between locked and unlocked positions in response to operation of the lock cylinder 650 to rotate the projection 675 within a 180 degree range of travel. The opening 572 is of a size that prevents the offset projection 675 from rotating to a position of alignment with the installation grooves 624, 294—whereby the locking member 550 also serves the function of retaining the locking plug 650 in the housing 200.

Referring to FIG. 2, the latch arm 400 is an elongate stamping formed from stainless steel, having a shank receiving formation 410 formed near one end region 412 thereof, and having a foot mounting formation 420 near the opposite end region 422 thereof. A central portion 430 connects the end regions 412, 422 and has an offset 432 formation that positions the end region 422 rearwardly with respect to the end region 412. A threaded opening 418 is formed through theend region 422. A shank engaging hole 414 is formed in the end region 410, and has opposed flats 416 that drivingly engage the shank end 370 for rotation therewith. A hex nit 411, a toothed washer 413 and a lock nut 415 adjustably retain the arm 400 on the shank 320.

The offset end portion 580 defines the notch 552 which has opposed side walls that are spaced to slide alongside and closely receive the opposed flat surfaces 372 of the shank 320 so as to prevent rotation of the shank 320 about the axis 321. The extent to which the offset end portion 580 is rearwardly offset from the central region 560 is such that, when the central region 560 is held in place in sliding relationship in engagement with the back wall of the housing, a forwardly facing surface 583 of the end region 580 closely overlies the rear end 331 of the barrel 330 and prevents rearward releasing movement of the shank 320. This preventative action is achieved by virtue of the surface 583 engaging the shank shoulder 374 and preventing the enlarged diameter portion 328 of the shank 320 from projecting rearwardly from the rear end 331 of the barrel 330. Thus, the locking member 550, when in its locked position, prevents rotation of the shank 320 by virtue of the engagement of the opposed side walls of the notch 552 with the flats 372 on the shank 320, and by virtue of the engagement of the surface 583 of the offset end 580 with the shank shoulder 374.

The resilient foot 500 that is carried by the latch arm 400 is a cap-like structure 502 that is formed from plastics material, preferably polyvinyl chloride (pvc) that has a hardness of about 80 durometers. The cap 502 has a cylindrical outer wall 504 that joins around, forwardly facing pad 506 at the circumference thereof. The cap 502 is hollow, and has an open end region 512 (see FIGS. 8, 10, 11).

A cap screw 518 is threaded into the threaded opening of the latch arm 400, and is rigidly connected to the arm 400 by tightening a nut 520 in place to clamp a toothed lock washer 522 between the nut 520 and the latch arm 400. The cap screw has a hex head 524 that can be inserted into the open end region 512 of the cap 502 and is of a size that permits the head 524 to be received in a tight fit.

The lock mechanism 600 includes a key cylinder 650 that is installed in the sleeve structure 280 of the housing 200 for slidably moving a locking member 550 between locked and unlocked positions for selectively permitting and preventing the handle 310 from axially moving the shank 320 to effect latching and unlatching movements of the resilient latching member 400.

The lock mechanism 600 includes a ring-like insert 610 that is provided for positioning in the rear end region 292 of the sleeve portion 280 of the housing 200. The insert 610 serves the function of closing rear end regions of the top and bottom grooves 288.

In order to provide an extension of the rounded installation groove 294 through the ring-like insert 610, a rounded groove 624 is formed in the insert 610 and is aligned with the rounded groove 294 of the sleeve members 280. In order to properly align the ring-like insert 610 for mounting on the housing 200 a pair of radially extending formations 626, 628 are provided to engage the grooves 296, 298 that are formed at the rear end of the sleeve members 280. The groove 296 and the formation 696 are of relatively small size and are configured to mate in a close slip fit. The groove 298 and the formation 698 are of relatively larger size and are configured to mate in a close slip fit. The difference in sizes of the mating components 296, 626 and 298, 628 prevents inadvertent switch mating of these similarly configured parts. The positioning of the relatively larger formation 628 as well as the rearwardly extending projection 620 at locations adjacent the area of the ring-like insert 610 that is structurally weakened by the provision of the rounded groove 624 serves to strengthen this area of the ring-like insert 610.

Referring to FIGS. 2, and 15, a key-receiving, tumbler-carrying plug assembly 650 is provided that has an enlarged diameter head portion 652 and a smaller diameter body 654 that are configured to be rotatably received in the opening and passage 282, 284 respectively. Radially extensible tumblers 656 form components of the plug 650 assembly and are extensible into the top and bottom grooves 288 to selectively permit and prevent rotation of the key cylinder assembly 650 with respect to the housing 200.

An offset cylindrical formation 675 is provided at the rear of the assembly 675 for engaging a back face of the insert member 610 to hold the cylinder assembly 650 in place in the housing 200. The plug assembly 650 is insertable into the sleeve 280 by inserting an appropriately configured key to retract the tumblers 656, and by aligning the offset cylindrical formation 675 with the groove 288 to move through the sleeve 280 to a position behind the insert 610. The plug 650 is retained in place on the housing 200 by preventing the offset cylindrical formation 675 from rotating to a position of alignment with the groove 294 (at which position the key cylinder assembly 650 could be removed.

If desired, the key locking cylinder assembly 650 can be replaced by tool operated plugs, as designated by numerals 800, 810 in FIG. 15. The plugs 800, 810 are shaped like the plug 650 and are insertable into the sleeve 280 in the manner described, with offset projections 675 aligned with the grooves 294, 624. The head portions of the plugs 800, 810 have circumferentially extending grooves 652 for carrying O-rings 653. Detent devices 802, 812 are preferably provided in the plugs 800, 810 as by forming radially extending bores 804, 814 that house springs 806, 816 and balls 808, 818. The balls 808, 818 are biased radially outwardly by the springs 806, 816 and cooperate with the grooves 288, 294 to prevent undesired rotation of the plugs 800, 810 and to give the operation of the plugs 800, 810 a good "feel."

The plugs 800, 810 carry tool receiving formations, typically a hex recess 820 for receiving an Allen wrench, or a narrow, shallow slot 822 for receiving a screwdriver.

To the extent that orientation terms such as "frontwardly," "rearwardly," "upwardly," "downwardly " and the like have been used in this document, it will be understood that such terms have been used simply for convenience and to facilitate understanding of the features that have been described, whereby the use of such orientation term should not be deemed to limit the scope of the claims that follow.

Although the invention has been described in its preferred form with a certain degree of particularity, it is understood that the present disclosure of the preferred form has been made only by way of example, and that numerous changes in details of construction as well as the combination and arrangement of parts may be made without departing from the spirit and scope of the invention as hereinafter claimed. It is intended that the patent shall cover by suitable expression in the appended claims, whatever features of patentable novelty exist in the invention disclosed.

What is claimed is:

1. A flush-mountable latch, comprising:

(a) housing means including a pan-shaped housing having a front wall, and having recess-defining wall formations that define a forwardly facing recess, with portions of the front wall forming a mounting flange that surrounds the recess;

(b) the housing being formed as a rigid, one-piece molded structure with the recess-defining wall formations including a back wall at the rear of the recess, with the back wall defining a rearwardly facing mounting surface;

(c) threaded fastener means rigidly connected to the back wall at spaced locations;

(d) handle means including a handle connected to the housing and being pivotally movable relative to the housing between a non-operated position and an operated position, and being rotatable relative to the housing while in its operated position;

(e) opening means formed through the recess-defining wall formations of the housing to establish a path of communication between the forwardly facing recess and a region that is located behind the back wall, including an opening formed through the back wall;

(f) handle-connected means extending through the opening means for connection to the handle and having a portion that extends into said region located behind the back wall for being moved within said region in response to movement of the handle between its non-operated and operated positions, including an elongate shaft-like shank that extends through the opening formed through the back wall and that is connected to the housing for axial movement along the axis of the shank and for rotary movement about the shank axis in response to pivotal and rotary movements of the handle, respectively;

(g) latch bolt means connected to the housing for movement relative to the housing between latched and unlatched positions, including a latch arm connected to the shank for rotation and translation therewith;

(h) a foot formation means carried on the latch arm for movement therewith to engage and disengage a surface on another structure;

(i) locking means for selectively engaging the shank of the handle-connected means to selectively lock the shank against movement relative to the housing, as by being configured to inhibit neither axial nor rotary movement of the shank when the locking means is in an unlocked position, and by being configured to engage and to cooperate with the shank so as to prevent both axial and rotary movement of the shank relative to the housing when the locking means is in a locked position; and, (j) means for mounting the locking means on the housing for movement relative thereto between said locked and unlocked positions.

2. The latch of claim 1 wherein the front wall has a front surface that extends in a smooth convex curve, with the thickness of the front wall portions that define the mounting flange differing across the front wall, with maximum thickness being provided where the front wall portions join with the recess-defining wall formations so as to form strong junctures between the front wall and the recess-defining wall formations all along the juncture of the recess-defining wall formation with the front wall.

3. The latch of claim 2 wherein the handle is formed as a rigid, one piece molded structure, the handle has a front wall that has a front surface, and the front surface of the handle is configured to extend contiguously with front surface portions of the housing when the handle is in its non-operated position.

4. The latch of claim 3 wherein the housing and the handle are formed from an injection molded, glass reinforced, polycarbonate based polymer blend thermoplastics material.

5. The latch of claim 1 wherein the threaded fasteners include a pair of threaded studs, each having a head formation embedded in the molded material that forms the back wall to provide a rigid connection between the threaded stud means and the back wall, and with the threaded studs each having an elongate rearwardly extending stem with a threaded region that extends rearwardly with respect to the back wall mounting surface and has a threaded region on the stem.

6. A flush-mountable latch, comprising:

(a) housing means including a pan-shaped housing having a front wall, and having recess-defining wall portions that define a forwardly-facing, rearwardly-extending recess that opens through the front wall, with portions of the front wall extending about the recess to define a mounting flange that perimetrically borders the recess, and with the mounting flange having rearwardly facing mounting flange surface portions that extend in a common plane for overlying forwardly facing surface portions of a closure or the like on which the housing is to be mounted;

(b) the housing being formed as a rigid, one-piece molded structure, with the recess-defining wall portions including a back wall that is located behind the front wall and that defines a flat, rearwardly facing back wall mounting surface that parallels said common plane;

(c) threaded fastener means rigidly connected to the back wall at locations spaced across the back wall;

(d) opening means formed through the recess-defining portions, with the opening means including an opening formed through the back wall;

(e) handle assembly means including a handle, a shaft-like member that extends through the back wall opening and has forward and rearward end regions that are interconnected by a central region, a pivot pin that extends through aligned holes that are formed in the handle and in the forward end region of the shaft-like member for pivotally connecting the handle to the shaft-like member for relative movement while the handle is in its non-operated position between nested and extended attitudes relative to the forwardly facing recess of the housing, a generally cylindrical barrel member that extends througgh the back wall opening and has a through-passage that journals the central region of the shaft-like member, interengageable formation means provided on the handle and on the barrel member for extending in juxtaposed relationship when the handle is in each of its nested and extended attitudes, biasing means interposed between the shaft-like member and the barrel member for biasing the interengageable formation means into engaging juxtaposition when the handle is in and moving between its nested and extended attitudes, and for cooperating with the interengageable formation means for detenting the handle toward maintaining its orientation in one or the other of its nested and extended attitudes, formation means for holding together as an assembly the handle, the pivot pin, the shaft-like member, the barrel member and the biasing means, and fastening means for mounting the barrel member within the back wall opening;

(f) the barrel member having front and rear surfaces at opposed ends thereof, and having an enlarged head at the front end for defining the front surface, having a threaded barrel shaped portion for extending through the back wall opening, with said through passage extending along an axis that is perpendicular to the plane of the back wall;

(g) the central region of the shaft-like member being of enlarged diameter with respect to the forward and rearward end regions and having the enlarged diameter central portion of the shank extending into the large diameter rearwardly opening end of the through passage;

(h) latch bolt means for connection to the rearwardly extending portion of the shank for rotation therewith, and having a mounting formation at a location spaced radially along the arm relative to the axis of the shank member; and, (i) foot means carried on the latch arm mounting formation for engaging a keeper surface to hold closed with respect to the keeper a closure on which the latch housing is mounted (j) locking means for selectively engaging the shank of the handle-connected means to selectively lock the shank against movement relative to the housing, as by being configured to inhibit neither axial nor rotary movement of the shank when the locking means is in an unlocked position, and by being configured to engage and to cooperate with the shank so as to prevent both axial and rotary movement of the shank relative to the housing when the locking means is in a locked position.

7. The latch of claim 6 wherein the handle is pivotally connected to the forward end region of the shank for movement between the nested attitude and the extended attitude, with the handle being rotatable with the shank about the axis of the of the shank when the handle is in its extended attitude between latched and unlatched positions, and the latch further includes;

(a) locking means including a locking member for engaging the shaft-like member to prevent relative rotation between the shaft-like member and the housing, and for preventing relatively axial movement of the shaft-like member with respect to the housing when the locking member is in its locked position; and, (b) means for movably mounting the locking member on the housing for movement between said locked position and an unlocked position wherein the locking member is out of engagement with the shaft-like member.

8. The latch of claim 7 wherein the locking means additionally includes a plug member that is mounted for rotation relative to the housing between locked and unlocked positions, with the plug member having a locking formation thereon for connection to the locking member to effect movement of the locking member between its locked and unlocked positions in response to rotation of the plug between locked and unlocked positions.

9. The latch of claim 7 wherein:

(a) the locking member is a one-piece metal stamping having a central portion that engages the back wall mounting surface and is slidable therealong; and, (b) the locking member has an offset portion that is formed as an integral part of the stamping and that extends rearwardly from the back wall mounting surface for defining a slot that is movable into and out of engagement with a pair of flat surfaces formed on the shaft-like member when the locking member is in its locked position.

10. The latch of claim 9 wherein the locking member has elongate slot means including a pair of spaced elongate slots formed through the central portion for receiving elongate shanks of a pair of threaded studs and for cooperating therewith to slidably mount the locking member on the housing for movement between its locked and unlocked positions.

11. The latch of claim 7 wherein:

(a) the housing has a generally cylindrical sleeve-like portion formed integrally with the front wall and defining a through passage that opens through the front wall, with the through passage having an inner wall surface that is of generally cylindrical configuration and extends concentrically about an imaginary axis that extends substantially perpendicularly to the common plane of the rearwardly facing mounting flange surface portions;

(b) at least one groove is formed in the inner wall surface of the through passage;

(c) a plug is configured to fit within the through passage and is journaled therein for rotation about the imaginary axis;

(d) an offset projection is connected to the plug and extends rearwardly therefrom at a location behind the rear wall of the plug, with at least a portion of the projection being offset from the imaginary axis so as to have a portion of the projection located radially outwardly beyond the inner wall of the passage; and, (e) the plug being insertable into the passage and being withdrawable therefrom only when the offset projection is in alignment with the groove so as to pass through the groove as the plug moves through the passage.

12. The latch of claim 11 wherein the locking member has a projection receiving formation that engages the rearwardly extending offset projection to drivingly interconnect the plug and the locking member so that the locking member is moved between its locked and unlocked positions in response to rotary movement of the plug between its locked and unlocked positions.

13. The latch of claim 12 wherein the inner cylindrical surface has at least one groove formed therein to receive tumblers of a key-operated locking plug to lock the locking plug against rotation, and the plug includes key-operated locking plug that is responsive to the insertion of a key therein for selectively permitting and preventing rotation of the locking plug between locked and unlocked positions.

14. The latch of claim 6 wherein:

(a) the handle has mounting formation means that includes a pair of spaced mounting portions that extend along opposite sides of the front end region of the shaft-like member;

(b) an elongate pin extends through aligned holes formed through the spaced mounting portions and through the front end region of the shaft-like member for pivotally connecting the handle and the shaft-like member to permit movement of the handle between its nested and extended attitudes; and, (c) first and second stop formations are provided on the mounting portions for engaging the front surface of the barrel means when the handle is in its nested and extended attitudes, with the first stop formation engaging the front surface of the barrel means when the handle is in its nested attitude, and with the second stop means engaging the front surface of the barrel means when the handle is in its extended attitude, and with the first and second stop formation means extending at substantially right angles with respect to each other.

15. The latch of claim 14 additionally including auxiliary stop means formed on the handle for engaging the back wall of the housing when the handle is in its nested position.

16. The latch of claim 6 wherein:

(a) the barrel means has a front surface, a back surface, an enlarged head portion defining the front surface, an elongate barrel-shaped portion that extends from the head to the back surface, a relatively small diameter hole opening through the front surface, a relatively large diameter hole opening through the back surface and extending through the barrel portion along said common axis and having a radially extending end wall that is located near the head portion and provides a transition between the relatively small diameter hole and the relatively large diameter hole that opens through the front and rear surfaces, respectively;

(b) the shaft-like member has a relatively large diameter central portion thereon that has an outer diameter which slip-fits within the relatively large diameter hole and which is positioned to extend into the relatively large diameter hole, with the front end region of the shaft-like member extending through the remainder of the barrel and through the relatively small diameter opening for pivotal connection to the handle means; and, (c) biasing means housed within the barrel and interposed between the end wall and the relatively large diameter portion of the shaft-like member for biasing the shaft-like member rearwardly along the axis.

17. The latch of claim 16 wherein:

(a) when the handle is in its nested attitude, the relatively large diameter central portion of the shaft-like member is housed entirely within the large hole of the barrel;

(b) when the handle is in its extended attitude, the relatively large diameter central region of the shaft-like member projects out of the barrel; and, (c) the locking member is operable to engage the shaft-like member at a location immediately behind the back face of the barrel to prevent the enlarged diameter central portion of the shaft-like member from moving out of the barrel when the locking member is in its locked position.

18. The latch of claim 6 additionally including:

(a) internally threaded mounting post means connected to the threaded fastener means for extending rearwardly from the housing and for defining a pair of threaded surface formations at a location behind the back wall;

(b) U-shaped mounting bracket means having a central wall formation for overlying the housing portions that define the recess, and having a pair of forwardly extending leg formations connected to opposed end regions of the central wall formation, and having a pair of holes provided through the central wall formation in alignment with the threaded surface formations;

(c) auxiliary threaded fastener means extending through the holes in the central wall formation of the mounting bracket and being threadedly connected to the threaded surface formations of the mounting post means for being tightened into threaded engagement with the mounting posts means to clamp the forwardly extending leg formations of the mounting bracket toward portions of the rearwardly facing mounting flange surface portions for clamping a structure onto which the housing is to be mounted between the rearwardly facing mounting flange surface portions and the forwardly extending formations.

19. The latch of claim 6 wherein the housing additionally has, formed integrally therewith, a plurality of locator projections that extend rearwardly from the rearwardly facing mounting flange surface at junctures of the rearwardly facing mounting flange surface with recess-defining wall portions.

20. The latch of claim 6 wherein:

(a) the mounting flange of the housing, as viewed from a front side thereof, is of generally rectangular configuration, having two opposed side edges of relatively equal length that are joined by two end edges that are of a substantially equal length that is less than the lengths of the sides;

(b) the rearwardly extending recess, as viewed from a front side thereof, is of generally rectangular configuration;

(c) the portions of the housing that define the rearwardly extending recess serve to locate the recess with respect to the mounting flange such that a relatively wider portion of the mounting flange is located at one end of the recess than is provided at the opposite end of the recess; and, (d) a generally cylindrical sleeve-like housing portion is provided as an integral part of the housing at a location near the one end of the recess and extending rearwardly from the relatively wide mounting flange portion.

21. The latch of claim 20 wherein the cylindrical mounting formation has a generally cylindrical opening formed therein that extends along an imaginary axis that is substantially perpendicular to the plane of the back face of the mounting flange, and that opens rearwardly.

22. The latch of claim 21 additionally including a plug-mounting opening that is formed through the front face of the relatively wider portion of the mounting region of the mounting flange and that communicates with the passage that extends through the cylindrical formation.

23. The latch of claim 6 additionally including adjustable connection means providing a rigid driving connection between the latch arm means and the rear end region of the shaft-like member.

24. The latch of claim 23 wherein the adjustable connection is formed, at least in part, by a portion of the rear end region of the shaft-like member being provided with threads, and by a pair of nuts that are threaded onto the threaded end region of the shaft-like member to clampingly engage opposed sides of the latch arm means between the nuts.

25. The latch of claim 6 wherein the handle is of generally L-shaped configuration and has a relatively wide operator engageable formation extending across one end region of the recess when the handle is in its nested attitude, and has a relatively thin connecting portion that interconnects the operator engageable formation and the mounting formation, and that extends along one side of the recess when the handle is in its nested attitude.

26. The latch of claim 20 wherein:

(a) the hole that is formed through the back wall of the housing is located in relatively close proximity to a corner region of the relatively rectangular recess;

(b) the mounting formation of the handle is configured such that when the handle is rotated about the axis of the shaft-like member when the handle is in its operating position, stop surface formations that are provided on side portions of the mounting formation limit the range of rotary movement of the handle with respect to the housing as by engaging the housing.

27. A flush-mountable latch, comprising:

(a) housing means including a pan-shaped housing having a front wall, and having recess-defining wall portions that define a forwardly-facing, rearwardly-extending recess that opens through the front wall, with portions of the front wall extending about the recess to define a mounting flange that perimetrically borders the recess, and with the mounting flange having rearwardly facing mounting flange surface portions that extend in a common plane for overlying forwardly facing surface portions of a closure or the like on which the housing is to be mounted;

(b) the housing being formed as a rigid, one-piece molded structure, with the recess-defining wall portions including a back wall that is located behind the front wall and that defines a flat, rearwardly facing back wall mounting surface that parallels said common plane;

(c) threaded fastener means rigidly connected to the back wall at locations spaced across the back wall;

(d) handle means including a handle formed as a rigid, one piece molded structure, with the handle being positioned in the recess and being connected to the housing means for movement relative thereto between non-operated and operated positions, with the handle having front surface portions that extend substantially contiguously with the front face of the front wall when the handle is in its non-operated position;

(e) opening means formed through the recess-defining portions, with the opening means including an opening formed through the back wall;

(f) barrel means having front and rear surfaces at opposed ends thereof, having an enlarged head at the front end for defining the front surface, having a threaded barrel shaped portion for extending through the back wall opening, and a having a through passage formed therethrough that extends along an axis that is perpendicular to the plane of the back wall;

(g) an elongate, shaft-like shank member extending through the barrel means and having front and rear end regions connected by an enlarged diameter central region with front and rear regions projecting forwardly from the front end of the barrel means and rearwardly from the rear end of the barrel means, respectively, with the enlarged diameter central portion of the shank being of relatively large diameter and extending into the large diameter rearwardly opening end of the through passage;

(h) latch bolt means for connection to the rearwardly extending portion of the shank for rotation therewith, and having a mounting formation at a location spaced radially along the arm relative to the axis of the shank member;

(i) foot means carried on the latch arm mounting formation for engaging a keper surface to hold closed with respect to the keeper a closure on which the latch housing is mounted;

(j) the barrel means having a front surface, a back surface, an enlarged head portion defining the front surface, an elongate barrel-shaped portion that extends from the head to the back surface, a relatively small diameter hole opening through the front surface, a relatively large diameter hole opening through the back surface and extending through the barrel portion along said common axis and having a radially extending end wall that is located near the head portion and provides a transition between the relatively small diameter hole and the relatively large diameter hole that opens through the front and rear surfaces, respectively;

(k) the shank means having a relatively large diameter central portion thereon that has an outer diameter which slip-fits within the relatively large diameter hole and which is positioned to extend into the relatively large diameter hole, with the front end region of the shank extending through the remainder of the barrel and through the relatively small diameter opening for pivotal connection to the handle means;

(l) biasing means is housed within the barrel and is interposed between the end wall and the relatively large diameter portion of the shank means for biasing the shank means rearwardly along the axis; and, (m) the biasing means including a compression coil spring that extends about the front end region of the shank, with the spring having a front end region that engages the end wall, and having a rear end region that engages the enlarged diameter portion of the shank.

28. The latch of claim 27 wherein resilient seal means is carried on the front end region of the shank and is interposed between the shank and the housing for preventing unwanted moisture from traveling through the passage.

29.

A flush-mountable latch, comprising:

(a) housing means including a pan-shaped housing having a front wall, and having recess-defining wall portions that define a forwardly-facing, rearwardly-extending recess that opens through the front wall, with portions of the front wall extending about the recess to define a mounting flange that perimetrically borders the recess, and with the mounting flange having rearwardly facing mounting flange surface portions that extend in a common plane for overlying forwardly facing surface portions of a closure or the like on which the housing is to be mounted;

(b) the housing being formed as a rigid, one-piece molded structure, with the recess-defining wall portions including a back wall that is located behind the front wall and that defines a flat, rearwardly facing back wall mounting surface that parallels said common plane;

(c) threaded fastener means rigidly connected to the back wall at locations spaced across the back wall;

(d) handle means including a handle formed as a rigid, one-piece molded structure, with the handle being positioned in the recess and being connected to the housing means for movement relative thereto between non-operated and operated positions, with the handle having front surface portions that extend substantially contiguously with the front face of the front wall when the handle is in its non-operated position;

(e) opening means formed through the recess-defining portions, with the opening means including an opening formed through the back wall;

(f) barrel means having front and rear surfaces at opposed ends thereof, having an enlarged head at the front end for defining the front surface, having a threaded barrel shaped portion for extending through the back wall opening, and a having a through passage formed therethrough that extends along an axis that is perpendicular to the plane of the back wall;

(g) an elongate, shaft-like shank member extending through the barrel means and having front and rear end regions connected by an enlarged diameter central region with front and rear regions projecting forwardly from the front end of the barrel means and rearwardly from the rear end of the barrel means, respectively, with the enlarged diameter central portion of the shank being of relatively large diameter and extending into the large diameter rearwardly opening end of the through passage;

(h) latch bolt means for connection to the rearwardly extending portion of the shank for rotation therewith, and having a mounting formation at a location spaced radially along the arm relative to the axis of the shank member;

(i) foot means carried on the latch arm mounting formation for engaging a keeper surface to hold closed with respect to the keeper a closure on which the latch housing is mounted; and, (j) adjustable mounting means interposed between the latch arm and the foot means for adjustably positioning the foot means in forward and rearward directions with respect to the latch arm.

30. The latch of claim 29, wherein:

(a) the adjustable mounting means includes a headed, threaded fastener having an elongate threaded shank portion that extends rearwardly from the head portion:

(b) the mounting formation on the latch arm means is a threaded opening formed in the latch arm means;

(c) the threaded shank portion of the threaded fastener is threaded into the threaded opening formed in the latch arm means; and, (d) the foot means is a resilient member that is press-fitted onto the enlarged head portion of the threaded fastener.

31. A flush-mountable lock, comprising:

(a) pan-shaped housing with a forwardly facing recess surrounded by a mounting flange that has a front face and a rear face, with the housing also having a locking plug mounting location defined adjacent of the recess by means of a generally sleeve-like structure which has a through passage that opens through the front face of the mounting flange;

(b) the housing being formed as a one-piece structure from injection molded plastics material and having a back wall at the rear of the forwardly facing recess, with the back wall closing the rear of the recess, and defining a flat mounting surface on the back of the housing, with a pair of threaded mounting studs having portions embedded in the material of the back wall and having threaded stud portions that project rearwardly from the back wall;

(c) an opening formed through the back wall;

(d) handle assembly means including a handle, a shaft-like member that extends through the back wall opening and has forward and rearward end regions that are interconnected by a central region, a pivot pin that extends through aligned holes that are formed in the handle and in the forward end region of the shaft-like member for pivotally connecting the handle to the shaft-like member for relative movement while the handle is in its non-operated position between nested and extended attitudes relative to the forwardly facing recess of the housing, a generally cylindrical barrel member that extends through the back wall opening and has a through-passage that journals the central region of the shaft-like member, interengageable formation means provided on the handle and on the barrel member for extending in juxtaposed relationship when the handle is in each of its nested and extended attitudes, biasing means interposed between the shaft-like member and the barrel member for biasing the interengageable formation means into engaging juxtaposition when the handle is in and moving between its nested and extended attitudes, and for cooperating with the interengageable formation means for detenting the handle toward maintaining its orientation in one or the other of its nested and extended attitudes, formation means for holding together as an assembly the handle, the pivot pin, the shaft-like member, the barrel member and the biasing means, and fastening means for mounting the barrel member within the back wall opening;

(e) latch bolt means connected to the housing for movement relative to the housing between latched and unlatched positions, including a latch arm connected to the shaft-like member for rotation and translation therewith; and, (f) a foot formation means carried on the latch arm for movement therewith to engage and disengage a surface on another structure;

(g) locking means for selectively engaging the shaft-like member to selectively lock the shaft-like member against movement relative to the housing, as by being configured to inhibit neither axial nor rotary movement of the shaft-like member when the locking means is in an unlocked position, and by being configured to engage and to cooperate with the shaft-like member so as to prevent both axial and rotary movement of the shaft-like member relative to the housing when the locking means is in a locked position; and, (h) means for mounting the locking means on the housing for movement relative thereto between said locked and unlocked positions.

32. The lock of claim 31 wherein the front wall has a front surface that extends in a smooth convex curve, with the thickness of the front wall portions that define the mounting flange differing across the front wall, with maximum thickness being provided where the front wall portions join with the recess-defining wall formations, so as to form strong junctures between the front wall and the recess-defining wall formations all along the juncture of the recess-defining wall formations with the front wall.

33. The lock of claim 32 wherein the handle is formed as a rigid, one piece molded structure, the handle has a front wall that has a front surface, and the front surface of the handle is configured to extend contiguously with front surface portions of the housing when the handle is in its non-operated position.

34. The lock of claim 33 wherein the housing and the handle are formed from an injection molded, glass reinforced, polycarbonate based polymer blend thermoplastics material.

* * * * *